US008691030B2

(12) United States Patent
Pugh et al.

(10) Patent No.: US 8,691,030 B2
(45) Date of Patent: Apr. 8, 2014

(54) LOW ALLOY STEELS WITH SUPERIOR CORROSION RESISTANCE FOR OIL COUNTRY TUBULAR GOODS

(75) Inventors: Dylan V. Pugh, Manvel, TX (US); Joseph C. Bondos, Houston, TX (US); Shiun Ling, Washington, NJ (US); Raghavan Ayer, Basking Ridge, NJ (US); Shalawn K. Jackson, Houston, TX (US); Narasimha-Rao V. Bangaru, Pittstown, NJ (US); Swarupa S. Bangaru, legal representative, Pittstown, NJ (US); Jayoung Koo, Seoul (KR)

(73) Assignee: ExxonMobil Upstream Research Company, Houston, TX (US)

( * ) Notice: Subject to any disclaimer, the term of this patent is extended or adjusted under 35 U.S.C. 154(b) by 382 days.

(21) Appl. No.: 12/600,949

(22) PCT Filed: May 2, 2008

(86) PCT No.: PCT/US2008/005730

§ 371 (c)(1),
(2), (4) Date: Nov. 19, 2009

(87) PCT Pub. No.: WO2008/156526

PCT Pub. Date: Dec. 24, 2008

(65) Prior Publication Data

US 2011/0120723 A1 May 26, 2011

Related U.S. Application Data

(60) Provisional application No. 60/936,185, filed on Jun. 18, 2007.

(51) Int. Cl.

| | |
|---|---|
| ***C22C 38/46*** | (2006.01) |
| ***C22C 38/28*** | (2006.01) |
| ***C21D 1/18*** | (2006.01) |
| ***C21D 6/00*** | (2006.01) |

(52) U.S. Cl.

USPC ..... 148/333; 148/507; 148/591; 148/622; 148/660; 148/663; 420/104; 420/120; 420/126; 420/127

(58) Field of Classification Search

USPC ..... 420/104, 120, 126, 127; 148/320, 333, 148/591, 660, 663, 507, 622

See application file for complete search history.

(56) References Cited

U.S. PATENT DOCUMENTS 3,960,617 A * 6/1976 Levin et al. ..... 148/121
4,830,828 A 5/1989 Anderson et al.

(Continued)

FOREIGN PATENT DOCUMENTS

DE 1032296 6/1958
DE 104101 2/1974 ..... C21D 1/26

(Continued)

OTHER PUBLICATIONS

Machine-English translation of Japanese patent 2006-348321, Hiraoka Yasushi, Dec. 28, 2006.*

(Continued)

*Primary Examiner* — Deborah Yee

(74) *Attorney, Agent, or Firm* — ExxonMobil Upstream Research Company

(57) ABSTRACT

The present application describes a steel composition that provides enhanced corrosion resistance. This steel composition includes one of vanadium in an amount of 1 wt % to 9 wt %, titanium in an amount of about 1 wt % to 9 wt %, and a combination of vanadium and titanium in an amount of 1 wt % to about 9 wt %. In addition, the steel composition includes carbon in an amount of 0.03 wt % to about 0.45 wt %, manganese in an amount up to 2 wt % and silicon in an amount up to 0.45 wt %. In one embodiment, the steel composition includes a microstructure of one of the following: ferrite, martensite, tempered martensite, dual phase ferrite and martensite, and dual phase ferrite and tempered martensite. Further, the present application describes a method for processing the steel composition and use of equipment such as oil country tubular goods, fabricated with the steel composition.

44 Claims, 12 Drawing Sheets

(56) References Cited

U.S. PATENT DOCUMENTS

| | | | |
|---|---|---|---|
| 5,019,189 | A | 5/1991 | Kumura et al. |
| 5,049,210 | A | 9/1991 | Miyasaka et al. |
| 5,180,450 | A | 1/1993 | Rao |
| 5,358,578 | A | 10/1994 | Tischhauser |
| 5,650,024 | A | 7/1997 | Hasegawa et al. |
| 5,653,826 | A | 8/1997 | Koo et al. |
| 5,772,795 | A | 6/1998 | Lally et al. |
| 5,849,116 | A | 12/1998 | Miyasaka et al. |
| 5,945,067 | A | 8/1999 | Hibner et al. |
| 6,168,756 | B1 | 1/2001 | Hirasawa et al. |
| 6,217,676 | B1 | 4/2001 | Takabe et al. |
| 6,248,187 | B1 | 6/2001 | Asahi et al. |
| 6,267,828 | B1 | 7/2001 | Kushida et al. |
| 6,315,946 | B1 | 11/2001 | Focht |
| 6,322,642 | B1 | 11/2001 | Bocquet et al. |
| 6,379,611 | B1 | 4/2002 | Komai et al. |
| 6,648,991 | B2 | 11/2003 | Turconi et al. |
| 7,169,239 | B2 | 1/2007 | Reavis et al. |
| 2003/0019549 | A1 | 1/2003 | Turconi et al. |
| 2006/0065327 | A1 | 3/2006 | Buck |
| 2006/0065335 | A1 | 3/2006 | Mizutani et al. |
| 2006/0086708 | A1 | 4/2006 | Coleman et al. |

FOREIGN PATENT DOCUMENTS

| | | |
|---|---|---|
| EP | 0557634 | 3/1992 |
| GB | 2345296 | 7/2000 |
| JP | 3902374 | 8/2001 |
| JP | 2002194481 | 7/2002 |
| JP | 4622327 | 6/2004 |
| JP | 2006-348321 | 12/2006 |
| JP | 2003/082435 | 3/2009 |
| WO | WO2008/156526 | 12/2008 |

OTHER PUBLICATIONS

Machine-English translation of Japanese patent 2004-300472, Nishikawa Tomoaki et al., Oct. 28, 2004.*

Machine-English translation of DE 1032296, Jun. 19, 1958.*

Andrade, C., et al., "Comparison of the Corrosion Behavior of Carbon Steel and 1% Chromium Steels for Seawater Injection Tubings", Proceedings of OMAE '01 20th International Conference on Offshore Mechanics and Arctic Engineering Jun. 3-8, 2001, Rio de Janeiro, Brazil.

Avner , S.H., Introduction to Physical Metallurgy, 2nd Ed., (McGraw-Hill, London, 1974) p. 160.

Changfeng, C, et al., "The Ion Passing Selectivity of CO2 Corrosion Scale on N80 Tube Steel," Corrosion/2003, Paper No. 03342.

Jones, D.A., Principles and Prevention of Corrosion, p. 146 (Macmillan, 1992)).

Kermani, M.B., et al., "Development of Low Carbon Cr-Mo Steels with Exceptional Corrosion Resistance for Oilfield Applications," Corrosion/2001, Paper No. 01065.

Kermani, M.B., et al., "Materials Optimization in Hydrocarbon Production", Corrosion/2005, Paper No. 05111.

Koch, G. H. et al., "Corrosion Costs by Industry Sector", *A Supplement to Materials Performance*, Jul. 2002, pp. 4-8.

Koshal, D., Manufacturing Engineer's Reference Book, ed. (Butterworth-Heinemann, Oxford, 1993) pp. 4-47.

Muraki, T., et al., "Development of 3% Chromium Linepipe Steel," Corrosion/2003, Paper No. 03117.

Nose, K., et al., "Corrosion Properties of 3% Cr Steels in Oil and Gas Environments," Corrosion/2001, Paper No. 01082.

Schofield , M. J., et al., "Corrosion Behavior of Carbon Steel, Low Alloy Steel and CRA's in Partially Deaerated Sea Water and Commingled Produced Water," Corrosion/2004, Paper No. 04139.

Sedriks, A.J., Corrosion of Stainless Steels, p. 1 and Fig. 1.1 (Wiley, 1996).

Takabe, H., et al., "Corrosion Resistance of Low Cr Bearing Steel in Sweet and Sour Environments," Corrosion/2002, Paper No. 02041.

International Search Report for PCT/US2008/05730 dated Jul. 30, 2008.

Floreen, S. (1982), "An Examination of Chromium Substitution in Stainless Steels," *Metallurgical Transactions A*, vol. 13A, Nov. 1982, pp. 2003-2013.

Kermani, M. B. et al. (2003) "Development of Superior Corrosion Resistance 3%Cr Steels for Downhole Applications.", *NACE International*, Paper 03116, 14 pages.

Tomashov, N. D. et al. (1964), "Effect of Supplementary Alloying Elements on Pitting Corrosion Susceptibility of 18 Cr-14Ni Stainless Steel", *Corrosion*, v.20, May 1964, pp. 166t-173t.

* cited by examiner

| Steel Composition | 5Cr | 5V |
|---|---|---|
| Observation | Pits | No Pit |

*FIG. 2*

LOW ALLOY STEELS WITH SUPERIOR CORROSION RESISTANCE FOR OIL COUNTRY TUBULAR GOODS

CROSS REFERENCE TO RELATED APPLICATIONS

This application is the National Stage of International Application No. PCT/US2008/005730, filed 2 May 2008, which claims the benefit of U.S. Provisional Application No. 60/936,185, filed 18 Jun. 2007.

FIELD OF THE INVENTION

The present invention describes a class of high strength low alloy steels with enhanced corrosion resistance. Although the high strength low alloy steels described in this application have broad industrial applicability, these steel alloys are particularly suitable as components used in hydrocarbon exploration and production. In particular, these high strength low alloy steels provide an economic alternative to the highly alloyed steels or inhibition technologies used for corrosion control in the hydrocarbon applications. As such, this application describes the composition of the high strength low alloy steels, steel processing and fabrication of the precursor steel into useful shapes for specific applications.

BACKGROUND

This section is intended to introduce the reader to various aspects of art, which may be associated with exemplary embodiments of the present techniques, which are described and/or claimed below. This discussion is believed to be helpful in providing the reader with information to facilitate a better understanding of particular aspects of the present techniques. Accordingly, it should be understood that these statements are to be read in this light, and not necessarily as admissions of prior art.

The production of hydrocarbons, such as oil and gas, has been performed for numerous years. To produce these hydrocarbons, one or more wells of a field are typically drilled into a subsurface location, which is generally referred to as a subterranean formation or basin. The process of producing hydrocarbons from the subsurface location typically involves the use of various equipment and facilities to transport the hydrocarbons from the subsurface formation to delivery locations. As such, the production and transportation of these hydrocarbons may involve equipment that includes "oil country tubular goods" (OCTG) such as tubulars, pipelines and various apparatus that are made of steels and other materials.

The fluids being transported often contain other fluids in addition to the hydrocarbons, such as the produced formation fluids, which may be corrosive and can corrode and damage the production and transportation equipment. To mitigate the consequences of corrosion, current approaches generally involve either using equipment made of expensive, highly alloyed metals known as "corrosion resistant alloys" (CRAs) or using inexpensive carbon steels coupled with additional corrosion control measures including inspections, coatings, inhibition, cathodic protection, periodic repair/replacement. A low cost alloy having enhanced corrosion resistance can thus provide cost saving benefits through either replacing the expensive CRAs to reduce the capital cost, or through replacing the carbon steels and eliminate the operating costs associated with the additional corrosion control measures.

It is further noted that a low cost alloy with enhanced corrosion resistance as described above can provide further benefits if it also has suitable corrosion resistance in the oxygen containing aqueous fluids typically encountered in water injection wells, and as such will have additional applications as OCTG tubulars in conversion wells and dual purpose wells. Conversion wells are those that are originally used as hydrocarbon producing wells, which are later converted into water injection wells. These wells typically use tubulars made of alloys having corrosion resistance to production fluids during their hydrocarbon producing phase, but later change the tubulars at additional costs to ones made of alloys having corrosion resistance in oxygen containing fluids for water injection operations. The dual purpose wells are those that simultaneously produce hydrocarbons, e.g. through the production tubulars, and inject water into subterranean formations, e.g. through the annulus between the production tubular and casing. These wells typically use tubulars made of expensive, highly alloyed CRAs having corrosion resistance in both production and oxygen containing fluids. Thus, the low cost alloys having enhanced corrosion resistance in both production and oxygen containing fluids can provide significant cost savings when used as OCTG tubulars in the case of conversion wells, which do not require changing the tubulars when converted into water injection wells, and in the case of dual purpose wells to replace the expensive CRA tubulars.

Typical CRA compositions derive their corrosion resistance from large alloying additions, such as chromium (Cr), exceeding about 12-13 weight-percent (wt %). This amount of chromium, e.g. 13 wt % Cr, is the minimum amount needed to form a complete surface coverage of nanometer thick passive film for the corrosion protection, see ASM Handbook, vol. 13A: Corrosion 2003 Ed. p. 697; and Corrosion of Stainless Steels, A. J. Sedriks, p. 1 and FIG. 1.1 (Wiley, 1996). In fact, compositions having iron (Fe)-13 wt % Cr is the basic composition of the lowest cost CRA, which is often referred to as 13Cr steels. With iron (Fe) being an inexpensive metal, any additional alloying generally increases the cost of the alloy. Accordingly, the higher classes of CRAs contain not only more chromium, but also more of other more expensive alloying elements, such as molybdenum (Mo), to further improve their passive film performance, and resulting in even higher material costs. In the oil and gas industry, concerns over aqueous corrosion often dictates the materials selected for application in the exploration, production, refining and chemical equipment and installations. See ASM Handbook, vol. 13A: Corrosion 2003 Ed. p. 697. For instance, in typical oil and gas exploration and production operations, carbon steels constitute the bulk of the structural alloys used due to their low cost, The more costly CRAs, on the other hand, are used only in production fields that have severe corrosion environments, and as a result they constitute only a small fraction of the total tonnage used. See ASM Handbook, vol. 13: Corrosion 1987 Ed. p. 1235.

To reduce costs, some research groups and steel companies have recently worked on developing low alloy carbon steels that have improved corrosion resistance, which typically focuses on developing Cr-containing steels in which the material cost is reduced by lowering the nominal chromium content to 3 wt % or less. The fraction of chromium available for corrosion resistance in the solid solution is then maximized by the addition of strong carbide forming elements as vanadium (V), titanium (Ti) and niobium (Nb). These elements, by tying up carbon in the matrix as carbide precipitates, effectively increase the amount of free chromium remaining in the matrix for corrosion resistance. For instance, steels containing 3 wt % Cr and 1 wt % Cr have been lab tested in synthetic sea and production waters, while various 3 wt % Cr steels have been lab tested in simulated sweet fluids as well as NACE (National Association of Corrosion Engineers) solutions. Further, carbon steels having Cr content ranging between 1-5 wt % have been tested with a variety of simulated production fluids. Finally, surface characteristics of 4 wt % Cr steels exposed to brines extracted from oil field fluids have also been investigated.

From these tests and reports, the 3 to 5 wt % Cr steels display superior corrosion resistance to carbon steels in sweet ($CO_2$) and mildly sour ($H_2S$) production environments. However, when exposed to oxygen levels above 20 parts per billion (ppb), localized corrosion in the form of pitting was identified on all samples. See Michael John Schofield et al., "Corrosion Behavior of Carbon Steel, Low Alloy Steel and CRA's in Partially Deaerated Sea Water and Commingled Produced Water," Corrosion, 2004 Paper No. 04139. Steels containing lower Cr levels, viz. 1 wt % Cr, display lower corrosion rates in oxygenated environments with the absence of pitting. See Chen Changfeng et al., "The Ion Passing Selectivity of CO2 Corrosion Scale on N80 Tube Steel," Corrosion, 2003, Paper No. 03342. Indeed, 1 wt % Cr steels are commercially available for water injection applications, however, these steels do not offer adequate protection under lower pH (5-6) sweet ($CO_2$) environments at temperatures of 60° C. See Michael John Schofield et al. and C. Andrade et al., Proceedings of OMAE '01 20th International Conference on Offshore Mechanics and Arctic Engineering, Jun. 3-8, 2001, Rio de Janeiro, Brazil. Consequently, the low Cr steels, containing 0-5 wt % Cr, are inadequate for applications in the conversion and dual purpose wells, which are described above.

Accordingly, the need exists for inexpensive, low alloy steels that combine resistance to uniform or general corrosion with resistance to pitting or localized corrosion in environments of interest in oil and gas production.

Further, additional information may be found in Supplement to Materials Performance, July 2002, pp. 4-8: FIG. 5; ASM Handbook, vol. 13A: Corrosion, 2003 ed. p. 697; Corrosion of Stainless Steels, A. J. Sedriks, p. 1 and FIG. 1.1 (Wiley, 1996); B. Kermani, et al., "Materials Optimization in Hydrocarbon Production", Corrosion/2005 Paper No. 05111; M. B. Kermani, et al., "Development of Low Carbon Cr—Mo Steels with Exceptional Corrosion Resistance for Oilfield Applications," Corrosion/2001, paper No. 01065; H. Takabe et al., "Corrosion Resistance of Low Cr Bearing Steel in Sweet and Sour Environments," Corrosion/2002, Paper No. 02041; K. Nose, et al., "Corrosion Properties of 3% Cr Steels in Oil and Gas Environments," Corrosion/2001, Paper No. 01082; T. Muraki, et al., "Development of 3% Chromium Linepipe Steel," Corrosion/2003, Paper No. 03117; Chen Changfeng et al., "The Ion Passing Selectivity of CO2 Corrosion Scale on N80 Tube Steel," Corrosion/2003, Paper No. 03342; M. J. Schofield, et al., "Corrosion Behavior of Carbon Steel, Low Alloy Steel and CRA's in Partially Deaerated Sea Water and Commingled Produced Water," Corrosion/2004 Paper No. 04139; C. Andrade, et al., "Comparison of the Corrosion Behavior of Carbon Steel and 1% Chromium Steels for Seawater Injection Tubings", Proceedings of OMAE '01 20th International Conference on Offshore Mechanics and Arctic Engineering Jun. 3-8, 2001, Rio de Janeiro, Brazil; CALPHAD—Calculation of Phase Diagrams, Eds. N. Saunders, A. P. Miodownik (Pergamon, 1998); and "Thermo-Calc ver M, Users' Guide," by Thermo-Calc Software, Thermo-Calc Software, Inc, McMurray, Pa. 15317, USA (2000).

SUMMARY OF INVENTION

In one embodiment, a steel alloy composition to provide corrosion resistance is described. The steel composition includes one of vanadium in an amount of 1 wt % to 9 wt %, titanium in an amount of 1 wt % to 9 wt %, and a combination of vanadium and titanium in an amount of 1 wt % to 9 wt %. In addition, the steel composition includes carbon in an amount of 0.03 wt % to 0.45 wt %, manganese in an amount up to 2 wt % and silicon in an amount less than 0.45 wt %.

In a second embodiment, a method of producing corrosion resistant carbon steel (CRCS) is described. The method includes providing a CRCS composition, annealing the CRCS composition at a suitable temperature and for a suitable time period to substantially homogenize the CRCS composition and dissolve the precipitates, and suitably quenching the CRCS composition to produce one of predominantly ferrite microstructure, predominantly martensite microstructure and predominantly dual phase microstructures. The CRCS composition includes one of vanadium in an amount of 1 wt % to 9 wt %, titanium in an amount of 1 wt % to 9 wt %, and a combination of vanadium and titanium in an amount of about 1 wt % to about 9 wt %, carbon in an amount of 0.03 wt % to 0.45 wt %, manganese in an amount up to 2 wt % and silicon in an amount less than 0.45 wt %.

In a third embodiment, a method associated with the production of hydrocarbons is described. The method includes obtaining equipment to be utilized with an wellbore environment, wherein the equipment is at least partially formed from a corrosion resistant carbon steel (CRCS) composition, installing the equipment in the wellbore; and producing hydrocarbons through the equipment. The CRCS composition comprises corrosion resistance alloying additions in an amount of 1 wt % to 9 wt %; carbon in an amount of 0.03 wt % to 0.45 wt %; manganese in an amount up to 2 wt %; silicon in an amount less than 0.45 wt %.

In a fourth embodiment, another steel composition to provide corrosion resistance is described. The steel composition includes vanadium in an amount of 1 wt % to 9 wt %, carbon in an amount of 0.03 wt % to 0.45 wt %, manganese in an amount up to 2 wt %, and silicon in an amount less than 0.45 wt %. The vanadium content in the steel composition may further be in an amount between 1 wt % to 3.5 wt %.

In a fifth embodiment, yet another steel composition to provide corrosion resistance is described. The steel composition includes titanium in an amount of 1 wt % to 6 wt %, carbon in an amount of 0.03 wt % to 0.45 wt %, manganese in an amount up to 2 wt % and silicon in an amount less than 0.45 wt %. The titanium content in the steel composition may further be in an amount between 1 wt % to 3.5 wt %.

In a sixth embodiment, still yet another steel composition to provide corrosion resistance is described. The steel composition includes a combination of titanium and vanadium in an amount of 1 wt % to 6 wt %; carbon in an amount of 0.03 wt % to 0.45 wt %; manganese in an amount up to 2 wt %; and silicon in an amount less than 0.45 wt %. The combination of titanium and vanadium may further be in an amount between 1 wt % to 3.5 wt %.

In a seventh embodiment, another steel composition to provide corrosion resistance is described. The steel composition includes a combination of chromium and vanadium in an amount of about 1 wt % to 5 wt %; carbon in an amount of 0.03 wt % to 0.45 wt %; manganese in an amount up to 2 wt %; silicon in an amount less than 0.45 wt %; and nickel in an amount less than 3 wt %.

BRIEF DESCRIPTION OF THE DRAWINGS

The foregoing and other advantages of the present technique may become apparent upon reading the following detailed description and upon reference to the drawings in which:

FIG. 2 is exemplary lab pitting corrosion test data measured using simulated water injection aqueous fluids in accordance with aspects of the present invention;

DETAILED DESCRIPTION

Figure 1A:
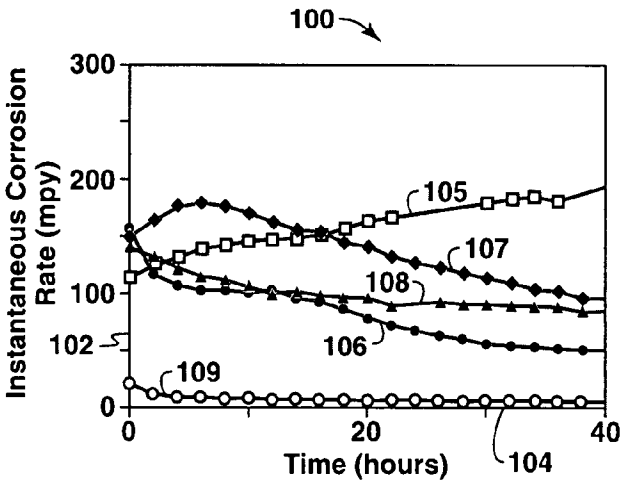
FIGS. 1A-1P are exemplary lab corrosion test data measured using simulated production and water injection aqueous fluids in accordance with aspects of the present invention.

In the following detailed description, the specific embodiments of the present invention will be described in connection with its preferred embodiments. However, to the extent that the following description is specific to a particular embodiment or a particular use of the present invention, this is intended to be illustrative only and merely provides a concise description of the exemplary embodiments. Accordingly, the invention is not limited to the specific embodiments described below, but rather, the invention includes all alternatives, modifications, and equivalents falling within the true scope of the appended claims.

The present techniques are directed to a range of steel chemical compositions, microstructures, and corrosion resistance of corrosion resistant carbon steels (CRCSs) for use in structural steel applications. Under the present techniques, the enhanced corrosion resistance of carbon steels is provided through the formation of a protective surface layer enriched with additional alloying elements, and in another aspect it is provided through the reduction of the kinetics of the surface electrochemical reactions underlying the corrosion processes. That is, the present techniques include (a) compositions of CRCS that provide enhanced corrosion resistance in aqueous production environments and water injection environments, (b) metallurgical processing and the resulting strong and tough microstructure of the CRCS, and (c) the use of CRCS in structural steel applications. These CRCSs may be utilized in a variety of applications, such as in the production and transportation of to hydrocarbons. In particular, the CRCSs, which may be referred to as CRCS materials or CRCS compositions, may be utilized for tubular equipment, such as piping, pipelines, flowlines and casing strings. The tubular equipment may be utilized in various applications, such as hydrocarbon production, water injection, conversion and dual purpose wells, for example. As such, the present techniques result in compositions, processes and systems that enhance well operations.

To begin, it should be appreciated that various oil country tubular goods (OCTG), such as piping, pipeline segments and wellbore tubulars may experience a wide range of environmental conditions in the wellbore environment. As a specific example, as shown in TABLE 1, a summary of the range of pertinent environmental conditions for sweet and water injection applications is shown below.

TABLE 1

| Service | T (F.) | $P_{total}$ (psia) | $P_{CO2}$ (psia) | $[O_2]$ (ppb) | [Cl] (wt %) | pH |
|---|---|---|---|---|---|---|
| Sweet production | 100-400 | 1,500-20,000 | 8-5,000 | 0-20 | 0-22 | 3-6.5 |
| Water injection | 75-250 | 15-10,000 | None | 20-100 | 3-16 | 7-8.5 |

These variables, such as temperature (T) in Fahrenheit (F), total pressure ($P_{total}$) in pounds per square inch absolute (psia), carbon dioxide partial pressure ($P_{CO2}$) in psia, dissolved oxygen concentration ($[O_2]$) in parts-per-billion (ppb), chloride concentration ([Cl]) in percent weight (wt %), and pH level (pH), determine environmental corrosivity in sweet and water injection applications. It is noted that, the sweet production fluids typically contain a very low amount, no more than 20 ppb, of dissolved oxygen ($[O_2]$). As such, carbon steels with inhibition or 13Cr steels are the typical prescribed material solutions for the oil field tubulars, such as production tubing strings, piping and pipeline segments. Alternatively, with injection water applications, up to 100 ppb of dissolved oxygen may be present. As a result, equipment, such as production tubulars, formed from 13Cr steels experiences pitting due to localized passive film breakdown. As such, equipment made of higher grade and more expensive CRAs, such as one formed from 22Cr (22 wt % Chromium composition steel) duplex, may have to be selected, which increases the costs for the project.

As discussed above, corrosion control technologies typically rely upon the addition of chromium (Cr) for corrosion resistance. However, CRCS composition or CRCS material technology utilizes the corrosion resistant properties of specific alloy additions, such as vanadium (V) and/or titanium (Ti), instead of relying upon Cr. Accordingly, the addition of V and/or Ti to the basic steel along with other alloying additions may provide enhanced corrosion resistance in comparison to carbon steels in environments typically encountered in oil and gas production. Generally, both V and Ti have been added to steels in smaller quantities for enhancing mechanical properties and for improving processing, but not for enhancing corrosion resistance properties. As such, one of the distinguishing aspects of the present techniques is the use of the corrosion resistance property enhancements provided by the V and Ti alloying additions.

Additionally, in oxygenated water environments, the V and/or Ti compositions may provide enhanced pitting resistance over other CRA steel compositions that rely upon chromium (Cr), which is a shortcoming of the state-of-the-art steels. Accordingly, the V and/or Ti alloying additions in the CRCS compositions are particularly advantageous for applications that either benefit from resistance to pitting corrosion (e.g., water injection well equipment applications), or that benefit from simultaneous resistance to general corrosion and pitting corrosion (e.g., dual purpose well equipment applications), or that benefit from general corrosion and pitting corrosion resistance separately during different periods of the well life (e.g., conversion well equipment applications).

For structural applications, the CRCS materials can be made to have beneficial bulk mechanical properties, including specific strength and toughness properties. This is accomplished through metallurgical processing steps that are suitable for specific CRCS compositions. Such metallurgical processing steps may include, but are not limited to, heat treatments and/or thermo-mechanical treatments.

In one or more embodiments, CRCSs have the following beneficial attributes: (i) compositions that enhance corrosion resistance, (ii) compositions that enable metallurgical processing to produce strong and tough microstructures, (iii) compositions that have a minimum yield strength that is at least 60 kilo pounds per square inch (ksi), (iv) toughness that meet L80 requirements as specified in industry standard API CT5, see API Specification 5CT, 8th Ed. 2005, p. 15, (v) compositions that can be made into low cost, seamless OCTG with enhanced corrosion resistance for applications in oil and gas exploration and production.

To provide the mechanical properties, the CRCS compositions and associated processing is formulated to have a yield strength exceeding about 60 ksi (413 Mega Pascal, or 413 MPa), more preferably exceeding about 70 ksi (482 MPa) and even more preferably exceeding about 80 ksi (551 MPa); and high toughness that complies with the L80 requirement per API 5CT standard.

Steel Composition

As noted above, the CRCS materials may be selected to form CRCS equipment for use in the oil and gas industry to provide corrosion resistance as well as mechanical performance. Beneficially, the steel having a CRCS composition may be used to form CRCS equipment, which may in some applications replace typical carbon steel equipment to reduce operating costs associated with corrosion control and in other applications replace CRA equipment to reduce the high initial capital expenses for CRA equipment.

The CRCS compositions are iron-based steels designed to impart and enable both the surface and bulk properties within the performance levels, which are produced through a combination of alloying elements, heat treatments and processing. In one or more embodiments, the CRCS composition consists essentially of iron, corrosion resistance alloying elements, and one or more other alloying elements. Minor amounts of impurities may be allowed per conventional engineering practice. Without limiting this invention, said impurities or minor alloying may include S, P, Si, O, Al, etc. For example, the presence of sulfur and phosphorous is addressed in more detail below. As such, the CRCS composition may include a total of up to 9 wt % of alloying additions. The role of the various alloying elements and the preferred limits on their concentrations for the present invention are discussed further below.

For the corrosion resistance alloying additions, the CRCS composition may include V, Ti and/or a combination of both to provide enhanced corrosion resistance. The V and/or Ti additions impart corrosion resistance to the steel via the formation of protective surface layers of oxide-hydroxide that are enriched in V and/or Ti to levels higher than that in the nominal steel compositions, as well as via the reduction of the surface corrosion reaction kinetics. For instance, in non-scaling sweet environments, the corrosion resistance alloying additions of the CRCS compositions provide protection by forming protective surface scale and by reducing corrosion kinetics, which are generally not provided by carbon steels. In scaling sweet environments that form protective siderite scale on steel surface, the CRCS compositions provide additional corrosion resistance in the same manner as described above to the corrosion resistance of the siderite scale. Accordingly, the addition of the V and/or Ti corrosion resistance alloying additions to the basic steel along with other alloying additions may provide enhanced corrosion resistance in comparison to carbon steels in environments typically encountered in oil and gas production. In addition, in oxygenated water environments, such V and/or Ti compositions may provide enhanced pitting resistance over other CRA steel compositions that rely upon Cr, which is a shortcoming of the state-of-the-art steels.

For structural applications, the CRCS materials can be made to have beneficial bulk mechanical properties, which are accomplished through suitable metallurgical processing steps to promote phase transformations that produce strong and tough microstructures in CRCS materials. These suitable metallurgical processing steps and the resulting microstructures are discussed further below. The effectiveness and the resulting microstructures of these processing steps, however, are strongly affected by the CRCS compositions. Indeed, as are discussed below, those skilled in the art may use the metallurgical phase diagrams shown in FIGS. 4A-4B to generate information on the relationships between the CRCS compositions, the suitable processing steps and the resulting microstructures. Accordingly, the CRCS compositions may be further designed for the purpose of producing the beneficial bulk mechanical properties, in addition to the already mentioned beneficial surface corrosion resistance properties.

For example, one or more embodiments of the CRCS compositions may include specific ranges of V, Ti, and/or a combination of both to provide corrosion resistance. For example, in one or more embodiments above or elsewhere herein, the CRCS compositions may include V, which is effective in enhancing corrosion resistance of the steel, and may be added to the CRCS composition in the range of 1 wt % to 9 wt % to provide enhanced corrosion resistance. Based on the phase diagram shown in FIG. 4A, which is discussed below, the amount of V addition is preferably in the range of 1 wt % to 6 wt %, where the V addition is more than the 1 wt % lower limit to impart corrosion resistance, and less than the 6 wt % upper limit for processability to produce suitable microstructures that provide bulk mechanical performance. To further improve the CRCS composition microstructures to ones that contain more than about 50 volume-percent (vol %) of the strong martensite or tempered martensite phases for enhanced bulk mechanical properties, as are discussed below, the amount of V addition is more preferably in the range of 1 wt % to 4 wt %, even more preferably in the range of 1 wt % to 2.5 wt %, and most preferably in the range of 1.5 wt % to 2.5 wt %.

In one or more embodiments above or elsewhere herein, the CRCS compositions may include Ti, which is also effective in enhancing corrosion resistance of the CRCS composition, and may be added to the CRCS composition in the range of 1 wt % to 9 wt % to provide enhanced corrosion resistance. Based on the phase diagram shown in FIG. 4B, which is discussed below, the amount of Ti addition is preferably in the range of 1 wt % to 3 wt % for processability to produce suitable microstructures that provide bulk mechanical performance. To further improve the CRCS composition microstructures to ones that contain more than about 50 vol % of strong martensite or tempered martensite phases for enhanced bulk mechanical properties, the amount of Ti addition is more preferably in the range of 1 wt % to 2.2 wt %, even more preferably in the range of 1 wt % to 1.8 wt %, and most preferably in the range of 1 wt % to 1.3 wt %.

In one or more embodiments above or elsewhere herein, the steel may include V and Ti. In these embodiments, the V and Ti may be added simultaneously with a total amount in the range of about 1 wt % to about 9 wt % to provide enhanced corrosion resistance. Based on the phase diagrams shown in FIGS. 4A and 4B, to improve processability for suitable strong and tough microstructures that provide bulk mechanical performance, the V and Ti may be added in a total amount that is preferably in the range of 1 wt % up to an amount that satisfies equation (e1) below:

$$Ti(wt\ \%)=3.0(wt\ \%)-0.5\times V(wt\ \%) \quad (e1)$$

where Ti(wt %) and V(wt %) are the amount of Ti and V additions in wt %, respectively. The equation (e1) can be used in designing CRCS compositions that contain a combination of V and Ti. As an example, consider such a CRCS composition that contains 3 wt % V, and equation (e1) can be used to determine 1.5 wt % to be the corresponding preferred upper limit amount of Ti addition that allows for improved processability. As another example, consider such a CRCS composition that contains 6 wt % V, and equation (e1) can be used to determine 0 wt % to be the corresponding preferred upper limit amount of Ti addition that allows for improved processability. This latter result is consistent with the above described preferred composition range of CRCS composition that contains only V but not Ti. To further improve the CRCS microstructures to ones that contain more than about 50 vol % of the strong martensite or tempered martensite phases for enhanced bulk mechanical properties, the V and Ti may be added in a total amount that is more preferably in the range of about 1 wt % up to an amount determined by equation (e2) below:

$$Ti(wt\ \%)=2.2(wt\ \%)-0.55\times V(wt\ \%) \quad (e2)$$

And even more preferably in the range of 1 wt % up to an amount determined by equation (e3) below:

$$Ti(wt\ \%)=1.8(wt\ \%)-0.72\times V(wt\ \%) \quad (e3)$$

In addition to the corrosion resistance alloying additions or elements, other suitable alloying elements may be included to enhance and/or enable other properties of the CRCS compositions. Nonlimiting examples of these additional alloying elements may include carbon, manganese, silicon, niobium, chromium, nickel, boron, nitrogen, and combinations thereof, for example. The CRCS compositions may include, for example, additional alloying elements that enable the base steel to be processed for improved bulk mechanical properties, such as higher strength and greater toughness. As such, these alloying elements are combined into the CRCS compositions to provide and/or enable adequate mechanical properties for certain structural steel applications, such as applications including a minimum yield strength rating of 60 kilo pounds per square inch (ksi), or preferably at least 80 ksi.

Certain alloying elements and preferred ranges are described in further details below. In one or more embodiments above or elsewhere herein, the CRCS compositions include carbon (C). Carbon is one of the elements used to strengthen and harden steels. Its addition also provides some secondary benefits. For example, carbon alloying addition stabilizes austenite phase during heating that can form harder and stronger lath martensite microstructure in CRCS compositions with appropriate cooling treatment. Carbon can also combine with other strong carbide forming elements in the CRCS compositions, such as Ti, niobium (Nb) and V to form fine carbide precipitates that provide precipitation strengthening, as well as inhibit grain growth during processing to enable fine grained microstructure for improved toughness at low temperature. To provide these benefits, carbon is added to CRCS compositions at an amount between 0.03 wt % and 0.45 wt %, preferably in the range between 0.03 wt % and 0.25 wt %, more preferably in the range between 0.05 wt % to 0.2 wt %, and even more preferably in the range between 0.05 wt % to 0.12 wt %.

In one or more embodiments above or elsewhere herein, the CRCS compositions may include manganese (Mn). Manganese is also a strengthening element in steels and can contribute to hardenability. However, too much manganese may be harmful to steel plate toughness. As such, manganese may be added to the CRCS composition up to an amount of no more than 2 wt %, preferably in the range of 0.5 wt % to 1.9 wt %, or more preferably in the range of 0.5 wt % to 1.5 wt %.

In one or more embodiments above or elsewhere herein, the CRCS compositions may include silicon (Si). Silicon is often added during steel processing for de-oxidation purposes. While it is a strong matrix strengthener, it nevertheless has a strong detrimental effect that degrades the steel toughness. Therefore, silicon is added to CRCS composition at an amount less than 0.45 wt %, preferably in a range between 0.1 wt % to 0.45 wt %.

In one or more embodiments above or elsewhere herein, the CRCS compositions may include Cr. In addition to providing enhanced weight loss corrosion resistance, Cr additions strengthen the steel through its effect of increasing the hardenability of the steel. However, as stated above, Cr additions can lead to susceptibility to pitting corrosion in aqueous environments that contain oxygen. The disclosed steels containing V and Cr, Ti and Cr, or V, Ti and Cr can provide simultaneously both weight loss corrosion resistance as well as pitting corrosion resistance. This dual corrosion resistance benefit is provided by adding V and/or Ti with Cr so that the net addition is in the range of about 1 wt % to 9 wt %. To improve the processability of the steel for the bulk mechanical property requirements of the target applications, however, the net amount of V and/or Ti with Cr addition is preferably in the range of 1 wt % to 3.5 wt %, and more preferably in the range of 1.5 wt % to 3 wt %, and even more preferably in the range of 2 wt % to 3 wt %.

In one or more embodiments above or elsewhere herein, the CRCS compositions may include nickel (Ni). Nickel addition may enhance the steel processability. Its addition, however, can degrade the corrosion resistance property, as well as increase the steel cost. Yet, because Ni is an austenite stabilizer, its addition may allow more V addition to offset the negative impact on the corrosion resistance properties. To improve steel processability, Ni is added in an amount less than 3 wt %, and preferably less than 2 wt %.

In one or more embodiments above or elsewhere herein, the CRCS compositions may include boron (B). Boron can greatly increase the steel hardenability relatively inexpensively and promote the formation of strong and tough steel microstructures of lower bainite, lath martensite even in thick sections (greater than 16 mm). However, boron in excess of about 0.002 wt % can promote the formation of embrittling particles of $Fe_{23}(C,B)_6$. Therefore, when boron is added, an upper limit of 0.002 wt % boron is preferred. Boron also augments the hardenability effect of molybdenum and niobium.

In one or more embodiments above or elsewhere herein, the CRCS compositions may include nitrogen (N). In titanium-containing CRCS compositions, nitrogen addition can form titanium nitride (TiN) precipitates that inhibit coarsening of austenite grains during processing and thereby enhancing the low temperature toughness of CRCS composition. For example, in one embodiment in which the base CRCS composition already contains sufficient titanium for corrosion resistance, N may then be added in the range from 10 parts per million (ppm) to 100 ppm. In another embodiment in which the base CRCS composition does not already contain Ti for corrosion resistance, then N may be added in the range from 10 ppm to 100 ppm when combined with the simultaneous addition of 0.0015 wt % to 0.015 wt % Ti. In this embodiment, Ti is preferably added to the CRCS composition in such an amount that the weight ratio of Ti:N is about 3:4.

In one or more embodiments above or elsewhere herein, the CRCS compositions may include niobium (Nb). Nb can be added to promote austenite grain refinement through formation of fine niobium carbide precipitates that inhibit grain growth during heat treatment, which includes at least 0.005 wt % Nb. However, higher Nb can lead to excessive precipitation strengthening that degrades steel toughness, hence an upper limit of 0.05 wt % Nb is preferred. For these reasons, Nb can be added to CRCS in the range of 0.005 wt % to 0.05 wt %, preferably in the range of 0.01 wt % to 0.04 wt %.

Further, sulfur (S) and phosphorus (P) are impurity elements that degrade steel mechanical properties, and may be managed to further enhance the CRCS compositions. For example, S content is preferably less than 0.03 wt %, and more preferably less than 0.01 wt %. Similarly, P content is preferably less than 0.03 wt %, and more preferably less than 0.015 wt %.

Steel Microstructure and Processing

The compositions of the CRCS described above provide beneficial corrosion resistance, strength and toughness properties. However, to achieve the mechanical property targets, the steels need to be further enhanced with appropriate metallurgical processings, which may include but are not limited to thermal and/or thermomechanical treatments, to produce suitable strong and tough microstructures. These suitable microstructures may include, but are not limited to, ones that comprise of predominantly ferrite phase, or predominantly martensite phase, or predominantly tempered martensite phase, or predominantly dual phase, where the dual phase may be either ferrite and martensite phases, or ferrite and tempered martensite phases. Additionally, the above mentioned ferrite, martensite, tempered martensite and dual phase microstructures may be further strengthened with second phase precipitates. CRCS materials having such suitable microstructures may, for example, have a minimum yield strength of 60 ksi, and toughness that meets L80 requirements per API CT5 standard. The appropriate metallurgical processing procedures to produce the suitable microstructures typically need to be designed to fit specific CRCS compositions, which are described further below.

The term "predominant" as used herein to describe the microstructure phases indicates that the phase, or phase mixture in the case of dual phase, exceeds 50 volume-percent (vol %) in the steel microstructure. The vol % is approximated to area-percent (area %) obtained by standard quantitative metallographic analysis such as using optical microscope micrographs or using Scanning Electron Microscope (SEM) micrographs. To arrive at the area %, as an example, without limiting this invention, the following procedure may be used: select randomly a location in the steel, take 10 micrographs at 500 times (X) magnification in an optical microscope or 2000× magnification in an SEM from adjacent regions of this location of metallographic sample prepared by standard methods known to those skilled in the art. From the montage of these micrographs, calculate the area % of the phases using a grid or similar such aid and this area % is reported as the volume %. To calculate the area %, automated methods through setting the gray scale and automatically computing the area % of the phases above and below the gray scale may also be used. See ASM Handbook, vol. 9: Metallography and Microstructures, 2004 Ed. p. 428.

As an example, the above mentioned beneficial microstructures for the CRCSs may be produced through a general heat treatment process. In this process, the CRCS compositions are first heated to an appropriately high temperature and annealed at that temperature for sufficiently long time to homogenize the steel chemistry and to induce phase transformations that convert the steels to, depending on the specific steel compositions, either essentially austenite phase or essentially a mixture of austenite and ferrite phases, or essentially ferrite phase. The phase transformations occurred via nucleation and growth processes, which result in the new phases to form in small grains. These newly formed small grains, however, can grow with increasing time if the steels are held at the annealing temperature. The grain growth may be stopped by cooling the steels down to appropriately low temperature.

The CRCS compositions may then be quenched at an appropriately fast cooling rate to transform most of the austenite phase to the strong and hard martensite phase. The ferrite phase, if present, is not affected by this fast cooling step. Cooling in air may also be used because it may provide a sufficiently fast cooling rate for certain steel compositions, as well as having the economic benefit of being a lower cost operation. After quenching, the CRCS compositions may then be subjected to tempering by reheating to an appropriate temperature and keeping at that temperature for sufficiently long time to improve the toughness properties. After these heat treatments, the final CRCS microstructures are ones that comprise either predominantly ferrite ($\alpha$), or predominantly martensite ($\alpha''$), or predominantly tempered martensite ($T-\alpha'$), or predominantly dual phases that are strong and tough.

The above described general heat treatment processes may be further enhanced through various processing steps. As an example, thermomechanical working while quenching the CRCS compositions after annealing may also be utilized. This process may reduce the grain size in the microstructure to provide further enhancement in both the strength and toughness properties. An example of this further enhancement process is the well known Mannesmann process commonly employed in the making of seamless OCTG tubing, in which hot steel is pierced and formed into tubular product while cooling. See Mannesmann process: *Manufacturing Engineer's Reference Book*, ed. D. Koshal (Butterworth-Heinemann, Oxford, 1993) pp. 4-47). As another example, the above described general heat treatment processes may also be enhanced by adding one or more thermal cycling steps after the annealing and before any subsequent tempering step to achieve grain refinement. During each of these thermal cycling steps, the CRCS compositions are heated up to an appropriate temperature that is no higher than the previous annealing temperature, and are held at this temperature for a short time period to transform the martensite phase, and the ferrite phase if present, to austenite phase but not so long as to induce significant grain growth. The preferred temperatures and times for the thermal cycling may be obtained through experimentation or modeling approaches that are known to those skilled in the art. An outcome of this phase transformation process is the refinement of the resulting austenite grains to smaller sizes. The CRCS compositions are then suitably quenched to convert the austenite phase back to the martensite phase or dual phase described above, but the resulting microstructures are ones that comprise finer, smaller grain sizes that enhance the strength and toughness properties. Each additional thermal cycling step may incrementally reduce the CRCS grain size, though at decreasing efficiency. These enhancements as detailed in the following are particularly suitable for predominantly martensitic or tempered martensitic or dual phase microstructures.

In one or more embodiments above or elsewhere herein, a CRCS composition containing V may be processed to generate the above described beneficial microstructure. Based on the phase diagram shown in FIG. 4A, this process may include steps of first heating and annealing the CRCS composition for a sufficiently long time period, and then quench the CRCS composition at appropriate cooling rate to ambient temperature. The annealing temperature is in the range of 850° C. to 1450° C., and preferably in the range of 1000° C. to 1350° C., even more preferably between 1000° C. and 1300° C. The annealing is performed for a sufficient time to dissolve precipitates and achieve essentially homogenized structures, with the time period being up to about 24 hours depending on the temperature, as is known to those skilled in the art. The annealing step may be followed by reheating the CRCS composition and temper it for a sufficiently long time period, e.g. less than about 12 hours, and then cooled to ambient temperature either through quenching or ambient air cooling. The tempering temperature is in the range of 400° C. up to or equal to the austenite formation temperature, known as Ac1. Preferably the upper tempering temperature does not exceed 760° C., and more preferably in the range of 550° C. to 670° C. Using this process, the CRCS compositions that contain V less than about 2.5 wt % may have microstructures that comprise of either predominantly as-quenched or tempered martensite phase, and the CRCS compositions that contain V in the range of 2.5 wt % to 6 wt % may have microstructures that comprise of predominantly dual phases, i.e., ferrite and either as-quenched or tempered martensite phases.

In one or more embodiments above or elsewhere herein, a CRCS composition containing Ti may be processed to generate the above described beneficial microstructure. Based on the phase diagram shown in FIG. 4B, this process may include steps of first heating and annealing the CRCS composition for a sufficiently long period of time, and then quenching the CRCS composition at appropriate cooling rate to ambient temperature. The annealing temperature is in the range of 850° C. to 1450° C., and preferably in the range of 900° C. to 1300° C., even more preferably in the range of 1050° C. to 1250° C. The annealing is performed for sufficiently long time to achieve essentially homogenized structures with the time period being up to about 24 hours depending on the temperature as is known to those skilled in the art. The annealing step may be followed by reheating the CRCS composition and tempering it for a sufficiently long time period, e.g. less than about 12 hours, and then quenched to ambient either through quenching or simple ambient air cooling. The tempering temperature is in the range of 400° C. to no more than the austenite formation temperature known as Ac1. Preferably, the upper temperature does not exceed 760° C., and more preferably is in the range of 550° C. to 670° C. Using this process, the CRCS compositions that contain Ti up to 1.8 wt % may have microstructures that comprise of either predominantly as-quenched or tempered martensite phase, and the CRCS compositions that contain Ti in the range of 1.8 wt % to 3 wt % may have microstructures that comprise of predominantly dual phases, i.e. ferrite and either as-quenched or tempered martensite phases.

In one or more embodiments above or elsewhere herein, the above described processing of Ti containing CRCS microstructures may be further enhanced by subjecting the CRCS compositions to additional thermal processing via annealing for a suitable period of time at an appropriate temperature in the range of 600° C. to 1300° C. to form precipitates of the Laves ($TiFe_2$) phase. These precipitates may provide additional strength. This additional thermal processing may either be part of the above described annealing and/or tempering process, or a stand-alone process.

In one or more embodiments above or elsewhere herein, a CRCS composition containing both V and Ti may be processed to generate the above described beneficial microstructure. Based on the phase diagrams shown in FIGS. 4A and 4B, which are discussed below, this process may include steps of first heating and annealing the CRCS composition for a sufficiently long period of time, and then quenching the CRCS composition at appropriate cooling rate to ambient temperature. The annealing temperature of the V and Ti containing CRCS composition in ° C., $T_{V+Ti}^{Anneal}$(° C.), may be determined using equation (e4) below:

$$T_{V+Ti}^{Anneal}(^\circ\text{ C.}) = \frac{V(\text{wt }\%) \times T_V^{Anneal}(^\circ\text{ C.}) + Ti(\text{wt }\%) \times T_{Ti}^{Anneal}(^\circ\text{ C.})}{V(\text{wt }\%) + Ti(\text{wt }\%)} \quad \text{(e4)}$$

where V(wt %) and Ti(wt %) are respectively the amounts of V and Ti in wt %, $T_V^{Anneal}$(° C.), $T_{Ti}^{Anneal}$(° C.) are respectively the corresponding annealing temperatures in ° C. for the V only and the Ti only CRCS compositions, as discussed above in previous paragraphs. The annealing is performed for a sufficiently long time to achieve essentially homogenized structures and may last as long as 24 hours depending on the temperature as is known to those skilled in the art. The annealing step may be followed by reheating the CRCS composition to temper it for a sufficiently long time period, up to 12 hours, and then quenched to ambient either through quenching or simple ambient air cooling. The tempering temperature of the V and Ti containing CRCS composition in ° C., $T_{V+Ti}^{Anneal}$(° C.), may be determined using equation (e5) below:

$$T_{V+Ti}^{Temper}(^\circ\text{ C.}) = \frac{V(\text{wt }\%) \times T_V^{Temper}(^\circ\text{ C.}) + Ti(\text{wt }\%) \times T_{Ti}^{Temper}(^\circ\text{ C.})}{V(\text{wt }\%) + Ti(\text{wt }\%)} \quad \text{(e5)}$$

where $T_V^{Anneal}$(° C.), $T_{Ti}^{Anneal}$(° C.) are respectively the corresponding tempering temperatures in ° C. for the V only and the Ti only CRCS compositions, as discussed above in previous paragraphs.

In the above described examples of CRCS heat treatments and processings, additional processing steps may be employed to achieve further enhancements in mechanical performance. As an example, this may be achieved by including the previously described thermomechanical working of annealed CRCS compositions during the quenching steps. Alternatively, as another example, this may also be achieved after annealing by adding one or more of the previously described thermal cycling steps, such that in each thermal cycling step the CRCS composition is reheated to an appropriate temperature that is not higher than its original annealing temperature.

Further, specific adjustment of processing parameters (e.g., heating temperature and duration) may be performed to accommodate specific CRCS compositions, as is commonly practiced in the steel industry. For instance, the CRCS compositions may be fine tuned, and the associated quenching and tempering parameters (i.e., soaking time and temperature) may be accordingly adjusted to obtain the desired candidate microstructures and their mechanical performance. The candidate microstructures include those described previously, the ones that comprise predominantly the martensite (as-quenched and tempered); dual ferrite-martensite phase (as-quenched and tempered); and additional microstructures such as the ferrite phase strengthened by Laves ($TiFe_2$) phase precipitates in the case of Ti containing CRCS composition.

Beneficially, the CRCS compositions provide a combination of enhanced resistance to uniform or general corrosion in hydrocarbon production environments, as well as enhanced resistance to pitting or localized corrosion in water injection environments. These CRCS compositions provide an appropriate balance of cost and corrosion resistance performance.

EXAMPLES

Figure 4A:
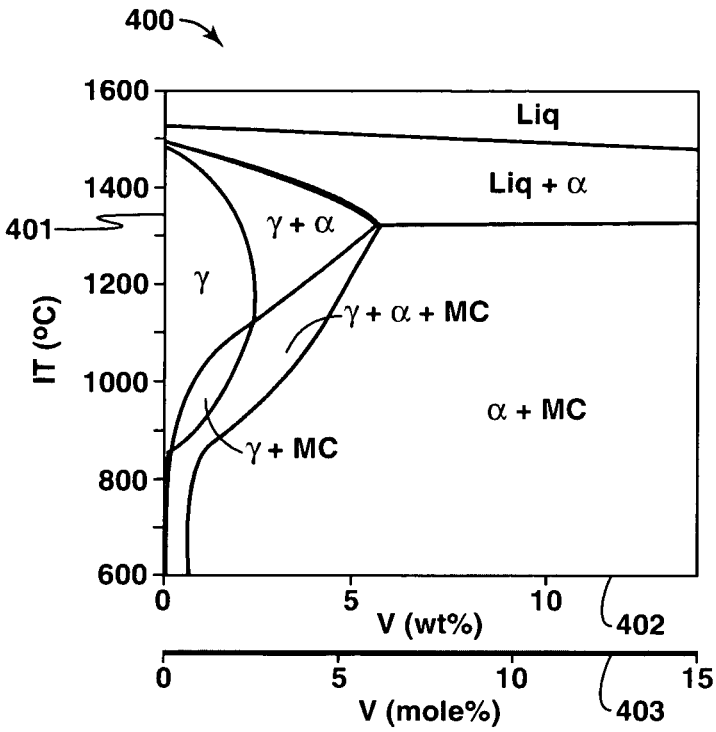
FIGS. 4A-4B are exemplary phase diagrams of the CRCS compositions calculated using Thermo-Calc computer model in accordance with aspects of the present invention.
Figure 4B:
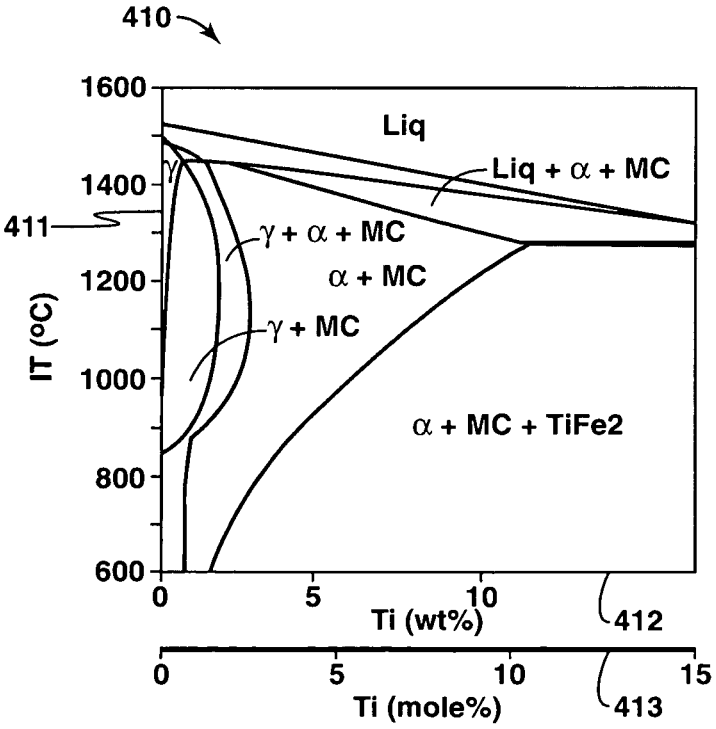
Figure 5:
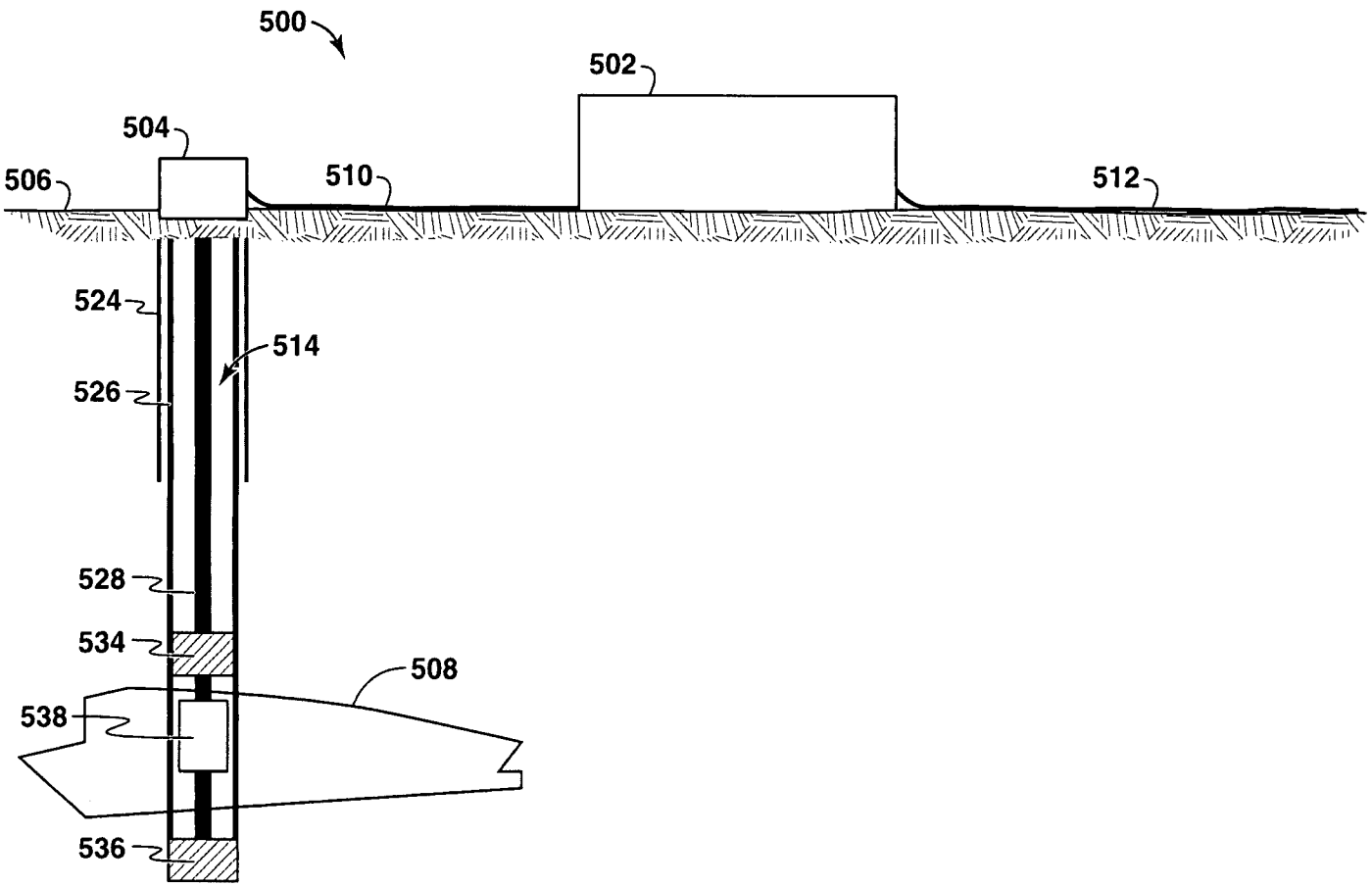
FIG. 5 is an exemplary production system in accordance with certain aspects of the present invention.

The following paragraphs include exemplary data that is provided to further explain various aspects of the CRCS compositions in accordance with aspects of the present invention. For instance, FIGS. 1A-1P are exemplary lab corrosion test data measured using simulated production and water injection aqueous fluids in accordance with aspects of the present invention. FIG. 2 is a summary of the visual examination results of steel coupons exposed to simulated water injection aqueous fluids. FIGS. 3A-3D are exemplary cross-section SEM micrographs and EDS elemental mappings of the corrosion surface of the steel coupons after corrosion tests. FIGS. 4A-4B are exemplary phase diagrams of the CRCS compositions calculated using Thermo-Calc computer model in accordance with aspects of the present invention. Finally, FIG. 5 is an exemplary production system in accordance with certain aspects of the present invention.

To begin, FIGS. 1A-1P are charts of corrosion rates measured in laboratory experiments in accordance with embodiments of the present techniques. In FIGS. 1A-1P, the corrosion rates are measured using electrochemical methodology (e.g., linear polarization resistance, see Principles and Prevention of Corrosion, D. A. Jones, p. 146 (Macmillan, 1992)) in a wide range of simulated production conditions. The steels used in these measurements include five compositions that respectively contain 1.5 atomic-percent (at %) V, 2.5 at % V, 5 at % V, 5 at % Ti and 5 at % Cr, which in weight-percent (wt %) correspond to 1.4 wt % V, 2.3 wt % V, 4.6 wt % V, 4.3 wt % Ti and 4.7 wt % Cr, respectively. Each of these steel compositions also contained additional 0.5Mn-0.1Si-0.07C, in wt %. In the discussions below, these steel compositions are referred to as 1.5V, 2.5V, 5V, 5Ti and 5Cr, respectively. The charts also include corrosion rates measured for a carbon steel (CS) and a stainless steel that contains 13 wt % Cr (13Cr) for comparison purpose to further clarify the enhancements in corrosion resistance of the CRCS compositions. The charts in FIGS. 1A-1L compare different steel compositions including 5V, 5Ti and 5Cr steels with CS and 13Cr in scaling and non-scaling testing environments. The charts in FIGS. 1M-1P compare steels having various V content, i.e. 1.5V, 2.5V and 5V steels with CS and 13Cr in scaling and non-scaling testing environments.

Figure 1B:
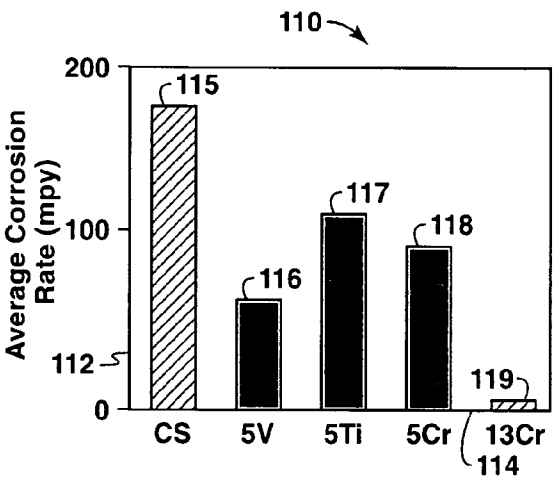

In FIGS. 1A and 1B, the corrosion rates are shown for measurements conducted in simulated aqueous production fluids that have compositions containing sodium chloride (NaCl) in an amount of about 10 wt %, about 15 psi $CO_2$, pH of about 5, and at temperature of about 150 F (Fahrenheit), which provide a non-scaling testing environment that does not promote the formation of siderite scale on the steels being tested. In chart 100 of FIG. 1A, the instantaneous corrosion rates 102 in mils-per-year (mpy) for responses 105-109 measured for different steel compositions are shown against time 104 in hours. The responses 105, 106, 107, 108, 109 are for CS, 5V, 5Ti, 5Cr and 13Cr steel compositions, respectively. As shown in this chart 100, the 13Cr composition represented by response 109 has the lowest instantaneous corrosion rate of about 5 mpy at about 40 hours. The CS composition represented by response 105 has the highest instantaneous corrosion rate that increases with increasing time to about 200 mpy at about 40 hours. The instantaneous corrosion rate of 5V CRCS composition represented by response 106 decreases with increasing time to about 50 mpy at about 40 hours, that of 5Ti CRCS composition represented by response 107 decreases with increasing time to about 98 mpy at about 40 hours, and that of 5Cr composition represented by the response 108 decreases with increasing time to about 86 mpy at about 40 hours. As such, the 5V and 5Ti CRCS compositions provide instantaneous corrosion rates that are respectively about ¼ and ½ that of carbon steel after 40 hours testing in this non-scaling test environment.

In chart 110 of FIG. 1B, the average corrosion rates 112 in mpy for responses 115-119 measured for different steel compositions are shown against their respective steel compositions 114. In this chart 110, the average corrosion rates 112 are obtained by averaging the instantaneous corrosion rates over about 40 hours from the start of the corrosion test. The responses 115, 116, 117, 118, 119 are for the CS, 5V, 5Ti, 5Cr and 13Cr steel compositions, respectively. As shown in this chart 110, the average corrosion rate of CS composition represented by response 115 is the highest at about 175 mpy, that of 5V CRCS composition represented by response 116 is about 60 mpy, that of 5Ti CRCS composition represented by response 117 is about 110 mpy, that of 5Cr composition represented by response 118 is about 95 mpy, and that of 13Cr composition represented by response 119 is about 7 mpy. As such, the 5V and 5Ti CRCS compositions provide average corrosion rates that are respectively about ⅓ and ⅔ that of carbon steel after about 40 hours testing in this non-scaling test environment.

Figure 1C:
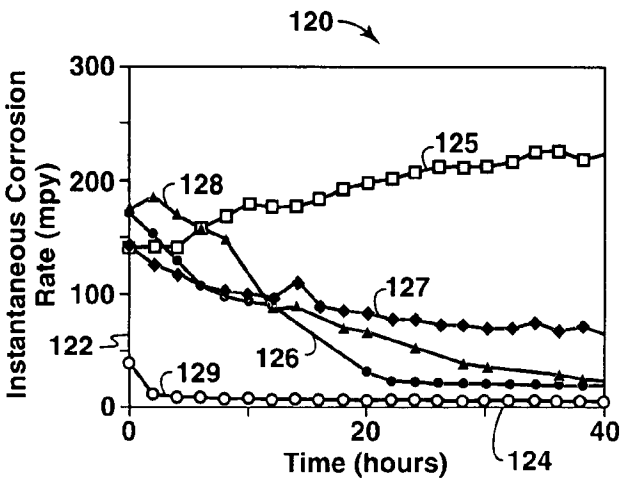
Figure 1D:
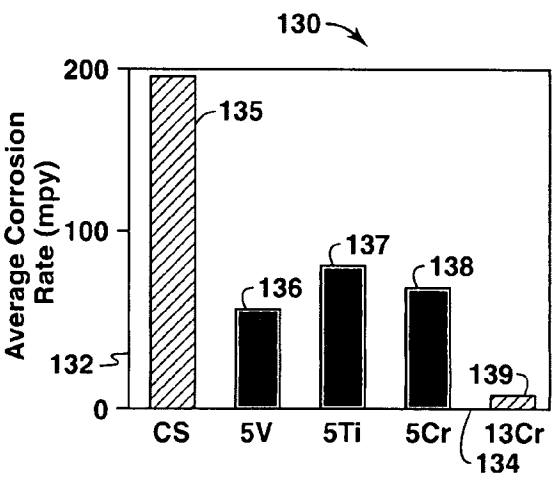

Similarly, in FIGS. 1C and 1D, the corrosion rates are shown for measurements conducted in simulated aqueous production fluids that have compositions containing NaCl in an amount of about 10 wt %, about 15 psi $CO_2$, pH of about 5, and temperature of about 180° F., which provide a non-scaling testing environment that does not promote the formation of siderite scale on the steels being tested. In chart 120 of FIG. 1C, the instantaneous corrosion rates 122 in mpy for different responses 125-129 measured for different steel compositions are shown against time 124 in hours. The responses 125, 126, 127, 128, 129 are for CS, 5V, 5Ti, 5Cr and 13Cr steel compositions, respectively. As shown in this chart 120, the 13Cr composition represented by response 129 has the lowest instantaneous corrosion rate that is about 6 mpy at about 40 hours. The CS composition represented by response 125 has the highest instantaneous corrosion rate that increases with increasing time to about 225 mpy at about 40 hours. The instantaneous corrosion rate of 5V CRCS composition represented by response 126 decreases with increasing time to about 20 mpy at about 40 hours, that of 5Ti CRCS composition represented by response 127 decreases with increasing time to about 66 mpy at about 40 hours, and that of 5Cr composition represented by response 128 decreases with increasing time to about 25 mpy at about 40 hours. As such, the 5V and 5Ti CRCS compositions provide instantaneous corrosion rates that are respectively about 1/10 and ⅓ that of carbon steel after 40 hours testing in this non-scaling test environment.

In the chart 130 of FIG. 1D, the average corrosion rates 132 in mpy for responses 135-139 measured for different steel compositions are shown against their respective steel compositions 134. In this chart 130, the average corrosion rates 132 are obtained by averaging the instantaneous corrosion rates over about 40 hours from the start of the corrosion test. The responses 135, 136, 137, 138, 139 are for the CS, 5V, 5Ti, 5Cr and 13Cr steel compositions, respectively. As shown in this chart 130, the average corrosion rate of the CS composition represented by response 135 is the highest at about 195 mpy, that of 5V CRCS composition represented by response 136 is about 50 mpy, that of 5Ti CRCS composition represented by the response 137 is about 85 mpy, that of 5Cr composition represented by response 138 is about 70 mpy, and that of 13Cr composition represented by response 139 is about 7 mpy. As such, the 5V and 5Ti CRCS compositions provide average corrosion rates that are respectively about ¼ and ½ that of carbon steel after 40 hours testing in this non-scaling test environment.

As described above for FIGS. 1A-1D, in these non-scaling aqueous production environments, the CRCS compositions provide the benefit of achieving two to ten times lower corrosion rates than carbon steel. This is because carbon steels do not form a siderite scale for corrosion protection in these non-scaling environments, whereas the CRCS compositions can form surface layers that are enriched in their respective CRCS alloying elements (e.g. V and/or Ti) to provide the beneficial corrosion protection.

Figure 1F:
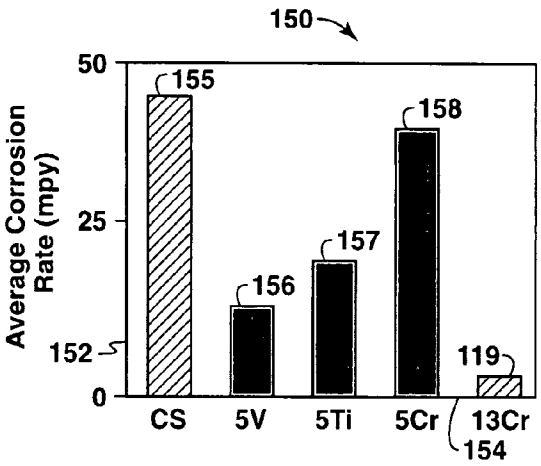
Figure 1E:
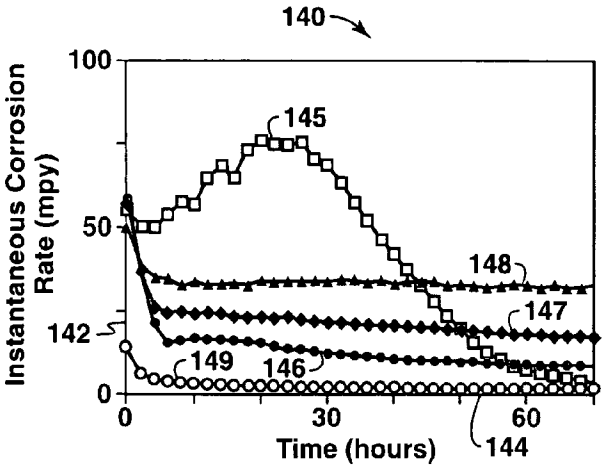

In FIGS. 1E and 1F, the corrosion rates are shown for measurements conducted in simulated aqueous production fluids that have compositions containing NaCl in an amount of about 10 wt %, sodium bicarbonate ($NaHCO_3$) in an amount of about 1.7 gram per liter (g/L), about 15 psi $CO_2$, pH of about 6.4, and temperature of about 180° F., which provide a scaling testing environment that promotes the formation of protective siderite scale on the steels being tested. In chart 140 of FIG. 1E, the instantaneous corrosion rates 142 in mpy for responses 145-149 measured for different steel compositions are shown against time 144 in hours. The responses 145, 146, 147, 148, 149 are for CS, 5V, 5Ti, 5Cr and 13Cr steel compositions, respectively. As shown in this chart 140, the 13Cr composition represented by response 149 has the lowest instantaneous corrosion rate that is about 2 mpy at about 70 hours. The CS composition represented by response 145 has an initially high instantaneous corrosion rate that reaches about 76 mpy at about 20 hours, then starts declining to about 4 mpy at about 70 hours due to the formation of a protective surface siderite scale. The instantaneous corrosion rate of 5V CRCS composition represented by response 146 has an initial drop to about 16 mpy after about 6 hours from test starts due to the formation of the CRCS element enriched protective surface layer. The response then decreases slowly with increasing time to about 9 mpy after about 70 hours due to the slower formation of an additional protective siderite top layer, which at slightly longer time may further decrease to about the same level as that of the siderite scale protected CS composition. The instantaneous corrosion rate of 5 Ti CRCS composition represented by response 148 has an initial drop to about 27 mpy after about 4 hours from test starts due to the formation of the CRCS element enriched protective surface layer. It then decreases slowly with increasing time to about 18 mpy at about 70 hours due to the slower formation of an additional protective siderite top layer, which at slightly longer time may further decrease to about the same level as that of the siderite scale protected CS composition. The instantaneous corrosion rate of 5Cr composition represented by response 147 has an initial drop to about 36 mpy after about 4 hours from test start. It then decreases slowly with increasing time to about 33 mpy at about 70 hours. As such, chart 140 shows that, before the formation of the protective siderite surface layer, the 5V and 5Ti CRCS compositions, provide the benefit of low instantaneous corrosion rates that are respectively about ⅓ and ⅕ that of CS. After the protective siderite surface layer formed, the 5V and 5Ti CRCS compositions may continue to provide low instantaneous corrosion rates that are comparable to that of siderite scale protected CS after 70 hours testing in this scaling test environment.

In chart 150 of FIG. 1F, the average corrosion rates 152 in mpy for responses 155-159 measured for different steel compositions are shown against their respective steel compositions 154. In this chart 150, the average corrosion rates 152 are obtained by averaging the instantaneous corrosion rates over about 70 hours from the start of the corrosion test. The responses 155, 156, 157, 158, 159 are for the CS, 5V, 5Ti, 5Cr and 13Cr steel compositions, respectively. As shown in this chart 150, the average corrosion rate of CS composition shown in response 155 has the highest average corrosion rate of about 44 mpy, that of 5V CRCS composition shown in response 156 is about 13 mpy, that of 5Ti CRCS composition shown in response 157 is about 19 mpy, that of 5Cr composition shown in response 158 is about 41 mpy, and that of 13Cr composition shown in response 159 is about 3 mpy. As such, the 5V and 5Ti CRCS compositions provide average corrosion rates that are respectively about ⅓ and ½ that of carbon steel after about 70 hours testing in this scaling test environment.

As described above for FIGS. 1E-1F, in this scaling aqueous production environment, the CRCS compositions can provide the benefit of achieving low corrosion rates that range from about equal to about three times lower than that of siderite protected carbon steel. This is because, in this scaling environment, the CRCS compositions can form protective siderite scale on top of their surface layers that are enriched in their respective CRCS alloying elements (i.e. V and/or Ti) to provide additional beneficial corrosion protection.

Similar observations as those described above have been made in corrosion tests conducted in more severe environments having higher temperatures and pressures. For instance, in FIGS. 1G and 1H, the corrosion rates are shown for measurements conducted in simulated aqueous production fluids that have compositions containing NaCl in an amount of about 10 wt %, about 100 psi $CO_2$, estimated pH of about 3.75, and at a temperature of about 180 F, which provide a non-scaling testing environment, which does not promote the formation of protective siderite scale on the steels being tested. In chart 160 of FIG. 1E, the instantaneous corrosion rates 162 in mpy for responses 165-169 measured for different steel compositions are shown against time 164 in hours. The responses 165, 166, 167, 168, 169 are for CS, 5V, 5Ti, 5Cr and 13Cr steel compositions, respectively. As shown in this chart 160, the 13Cr composition shown in response 169 has the lowest instantaneous corrosion rate that is about 5 mpy at about 140 hours. The CS composition shown in response 165 has an initially high instantaneous corrosion rate that reaches about 1080 mpy at about 11 hours. This results in a significant amount of dissolved iron that modifies the test solution chemistry to one that starts promoting siderite scale formation, resulting in the subsequent drop in the instantaneous corrosion rate to a level of about 5 mpy at about 140 hours. The instantaneous corrosion rate of 5V CRCS composition shown in response 166 has an initial drop to about 340 mpy at about 6 hours due to the formation of the CRCS element enriched protective surface layer, and subsequently remained at about that level until test end at about 140 hours. The instantaneous corrosion rate of 5Ti CRCS composition represented by response 167 provides similar observations as that for 5V CRCS composition in response 166 described above. The instantaneous corrosion rate of 5Cr composition represented by response 168 decreases slowly with increasing time to about 174 mpy at about 140 hours. As such, without the formation of the protective siderite surface layer on CS, both the 5V and 5Ti CRCS compositions provide instantaneous corrosion rates that are about ⅓ that of CS.

Figure 1H:
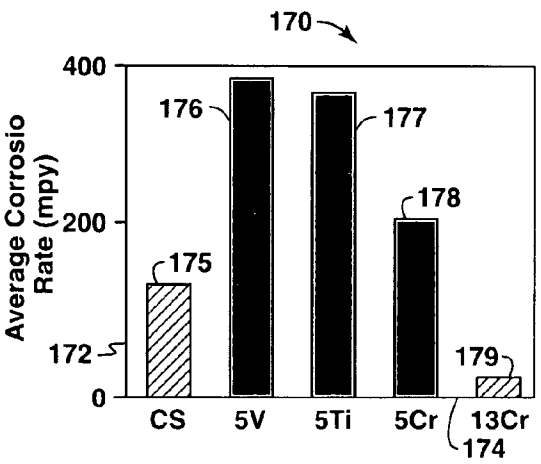
Figure 1G:
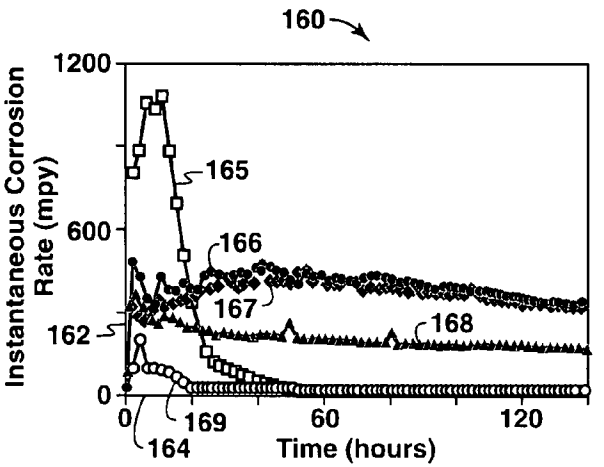

In chart 170 of FIG. 1H, the average corrosion rates 172 in mpy for responses 175-179 measured for different steel compositions are shown against their respective steel compositions 174 in hours. In this chart 170, the average corrosion rates 172 are obtained by averaging the instantaneous corrosion rates over about 140 hours from the start of the corrosion test. The responses 175, 176, 177, 178, 179 are for the CS, 5V, 5Ti, 5Cr and 13Cr steel compositions, respectively. The average corrosion rates of 5V CRCS, 5 Ti CRCS, 5Cr, and 13Cr compositions represented by responses 176, 177, 178, 179 are about 390 mpy, 380 mpy, 210 mpy, and 50 mpy, respectively. It is noted that the average corrosion rate of CS composition shown in response 175 (130 mpy) does not properly account for the effect of the changing test condition involving modified water chemistry that induced siderite scale formation as described above, and hence cannot be directly compared to the average corrosion rates measured for the other compositions in this test environment.

As described above for FIGS. 1G-1H, in this test the instantaneous corrosion rates more clearly represent the corrosion behavior of the different steel compositions displayed than the average corrosion rates. Based on the instantaneous corrosion rates measured in this non-scaling aqueous production environment, the CRCS compositions provide the benefit of achieving low corrosion rates that are about ⅓ that of carbon steel.

Figure 1J:
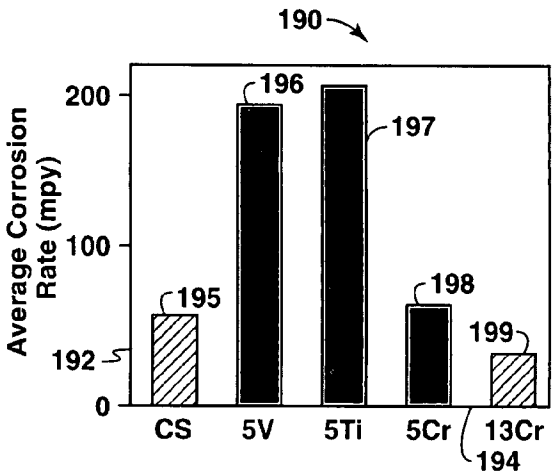
Figure 1I:
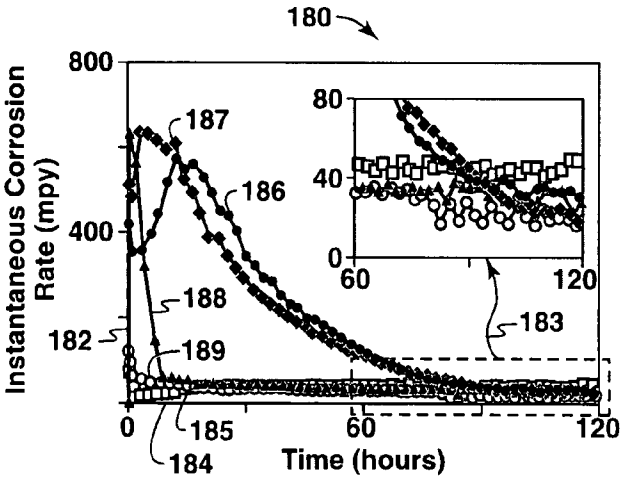

In FIGS. 1I and 1J, the corrosion rates are shown for measurements conducted in simulated aqueous production fluids that have compositions that include NaCl in an amount of about 10 wt %, $NaHCO_3$ in an amount of about 0.5 g/L, about 200 psi $CO_2$, estimated pH of about 5, and temperature of about 250 F, which provides a scaling testing environment that promotes the formation of protective siderite scale on the steels being tested. In the chart 180 of FIG. 1I, the instantaneous corrosion rates 182 in mpy for responses 185-189 measured for different steel compositions are shown against time 184 in hours. The responses 185, 186, 187, 188, 189 are for CS, 5V, 5Ti, 5Cr and 13Cr steel compositions, respectively. Additionally, the window 183 is an expanded portion of the chart 180 that includes the responses 185-189 measured in the time period 60-120 hours. As shown in this chart 180 and the window 183, the instantaneous corrosion rate of 13Cr represented by response 189 displays a rapid drop from an initial rate of about 120 mpy to about 60 mpy after about 1 hour, then declines further gradually to about 19 mpy at about 120 hours. The instantaneous corrosion rate of CS represented by response 185 displays a rapid drop from an initially high rate of about 880 mpy (not shown) to about 40 mpy after about 1 hour, which is due to the formation of a protective surface siderite scale. The instantaneous corrosion rate of CS composition then remains constant and is about 44 mpy at about 120 hours. The instantaneous corrosion rate of 5V CRCS composition represented by response 186 experiences an initial gradual rise to about 573 mpy at about 12 hours, after which it gradually declines to a low value of about 31 mpy at about 120 hours as the siderite protective scale forms. The instantaneous corrosion rate of 5Ti CRCS composition represented by response 187 experiences an initial gradual rise to about 635 mpy at about 3 hours, after which it declines to a low value of about 23 mpy at about 120 hours as the siderite protective scale forms. The instantaneous corrosion rate of 5Cr composition represented by response 188 has an initial drop to about 68 mpy at about 8 hours, after which it declines gradually to about 29 mpy at about 120 hours as the siderite protective scale forms. As such, the chart 180 shows that before the formation of the protective siderite surface scale, the 5V and 5Ti CRCS compositions provide the benefit of low instantaneous corrosion rates that are respectively about ⅔ and ¾ that of CS. After the protective siderite surface scale formed, the 5V and 5Ti CRCS compositions may continue to provide low instantaneous corrosion rates that are comparable to that of siderite scale protected CS after 120 hours testing in this scaling environment.

In chart 190 of FIG. 1J, the average corrosion rates 192 in mpy for responses 195-199 measured for different steel compositions are shown against their respective steel compositions 194. In this chart 190, the average corrosion rates are obtained by averaging over about 120 hours from the start of the corrosion test. The responses 195, 196, 197, 198, 199 are for the CS, 5V, 5Ti, 5Cr and 13Cr steel compositions, respectively, and show average corrosion rates of 52 mpy, 193 mpy, 206 mpy, 60 mpy, 30 mpy, respectively. It is noted that a comparison of the average corrosion rates of CS composition versus the 5V and 5Ti CRCS compositions does not accurately account for the effect of different times required to form the protective siderite scales. As such, the average corrosion rates shown in chart 190 are not a good measure of the relative corrosion protection for different steel compositions.

Figure 1L:
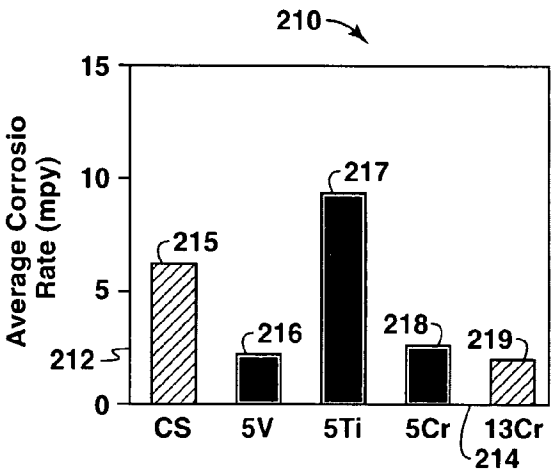
Figure 1K:
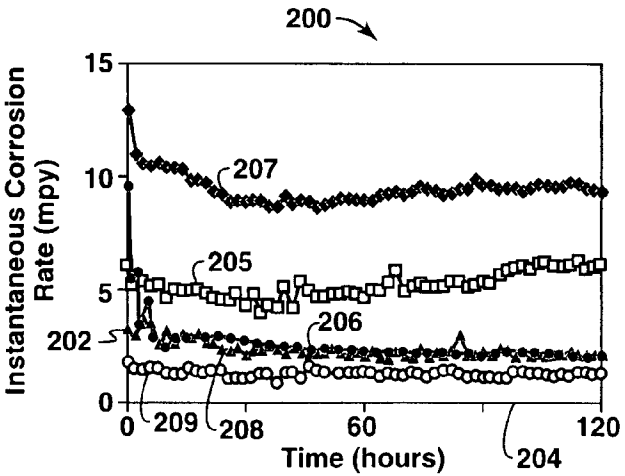

In FIGS. 1K and 1L, the corrosion rates are shown for measurements conducted in simulated water injection fluids that have compositions of simulated seawater prepared per ASTM-D1141 standard, containing dissolved oxygen ($O_2$) in an estimated amount of about 100 ppb, pH of about 8, and at a temperature of about 180 F. In chart 200 of FIG. 1K, the instantaneous corrosion rates 202 in mpy for responses 205-209 for different steel compositions are shown against time 204 in hours. The responses 205, 206, 207, 208, 209 are for CS, 5V, 5Ti, 5Cr and 13Cr steel compositions, respectively. As shown in chart 200 of FIG. 1K, the instantaneous corrosion rates of CS, 5V, 5Ti, 5Cr, and 13Cr compositions represented respectively by responses 205, 206, 207, 208, 209 are about 6.2 mpy, 2.2 mpy, 9.4 mpy, 2.2 mpy, and 1.5 mpy, respectively. Comparing chart 200 of FIG. 1K to charts 100, 120, 140, 180 respectively of FIGS. 1A, 1C, 1E, 1G, and 1I, it is noted that all five tested steel compositions have a similar relatively low level of instantaneous corrosion rates after 120 hours testing in simulated water injection fluids. In particular, the 5V CRCS composition provides instantaneous corrosion rate that is about ⅓ that of carbon steel after 120 hours testing in simulated water injection fluids.

Similarly, in chart 210 of FIG. 1L, the average corrosion rates 212 in mpy for responses 215-219 measured for different steel compositions are shown against their respective steel compositions 214. In this chart 210, the average corrosion rates 212 are obtained by averaging the instantaneous corrosion rates over about 120 hours from the start of the corrosion test. The responses 215, 216, 217, 218, 219 are for the CS, 5V, 5Ti, 5Cr and 13Cr steel compositions, respectively. As shown in this chart 210, the average corrosion rates of CS, 5V, 5Ti, 5Cr, and 13Cr compositions represented by responses 215, 216, 217, 218, 219 are about 6 mpy, 2 mpy, 9.2 mpy, 2.5 mpy, and 1.9 mpy, respectively. Comparing chart 210 of FIG. 1L to charts 110, 130, 150, 190 respectively of FIGS. 1B, 1D, 1F, 1H, and 1J, it is noted that all five tested steel compositions have a similar relatively low level of average corrosion rates after 120 hours testing in simulated oxygenated water injection fluids. In particular, the 5V CRCS composition provides an average corrosion rate that is about ⅓ that of carbon steel after 120 hours testing in simulated water injection fluids.

As described above for FIGS. 1K-1L, in the water injection environments, the CRCS compositions provide the benefit of relatively low corrosion rates, and the 5V CRCS composition in particular provides the benefit of achieving low corrosion rate that is about ⅓ that of carbon steel.

Figure 1N:
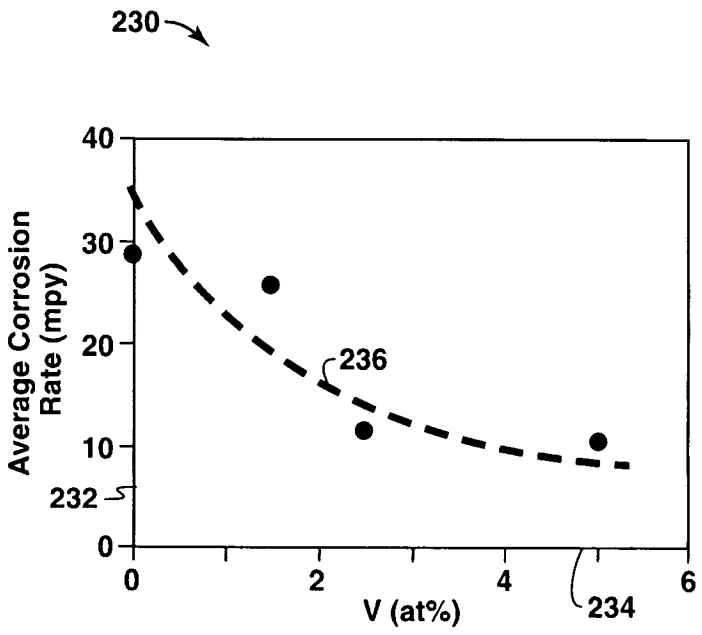
Figure 1M:
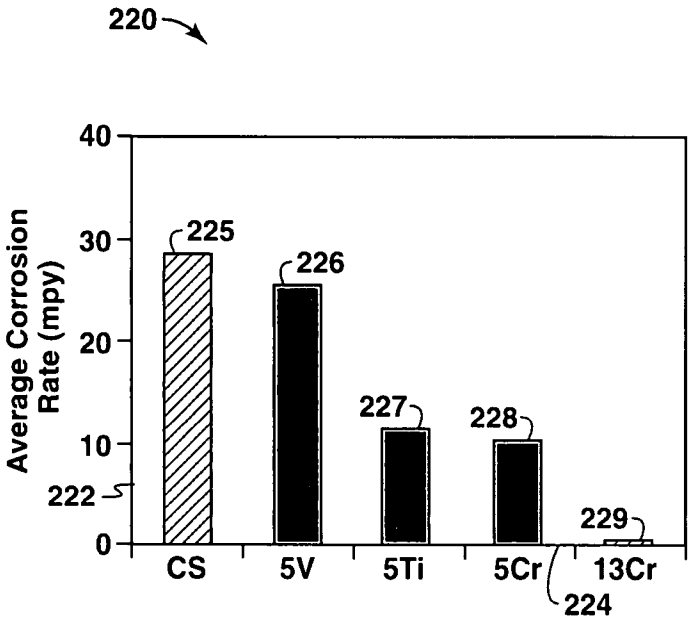
Figure 1P:
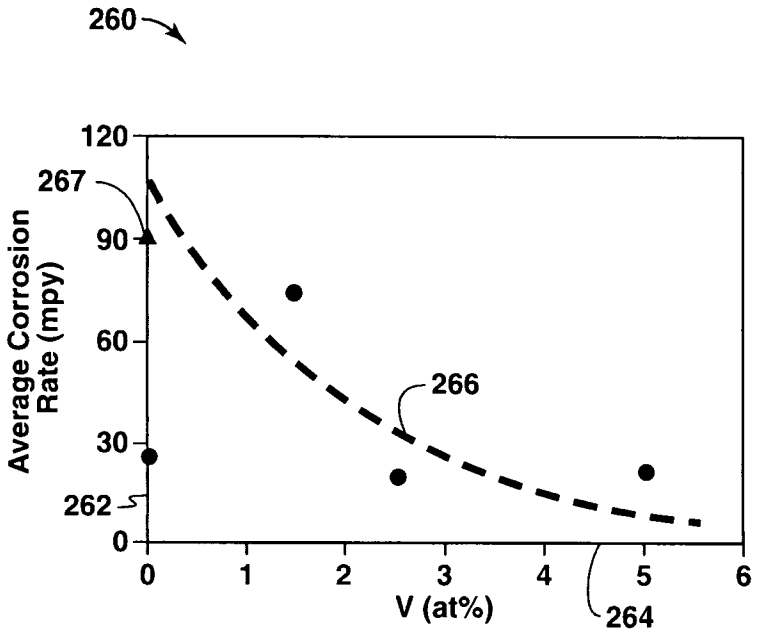

FIGS. 1M-1N compare the average corrosion rates of 1.5V, 2.5V, and 5V CRCS steels with CS and 13Cr in a "non-scaling" testing environment. The corrosion rates are shown for measurements conducted in simulated aqueous production fluids containing about 10 wt % NaCl, about 15 psi $CO_2$, pH of about 5, and a temperature of about 180° F., which provide a non-scaling testing environment that does not promote the formation of siderite scale on the steels being tested. The purpose of this test is to show an exemplary corrosion rate depending on vanadium content, including CS and 13Cr as baselines. FIG. 1M shows chart 220 illustrating the average corrosion rates 222 in mpy for responses 225-229 measured for different steel compositions 224. In this chart 220, the average corrosion rates 222 are obtained by averaging the instantaneous corrosion rates over about 150 hours from the start of the corrosion test. The responses 225, 226, 227, 228, 229 are for the CS, 1.5V, 2.5V, 5V and 13Cr steel compositions, respectively. The chart 220 shows lower average corrosion rates 222 as the vanadium content increases. FIG. 1N shows chart 230 displaying the average corrosion rates of CS, 1.5V, 2.5V, and 5V as points and showing a free hand drawn trend line 236 for the four points. As shown, the corrosion resistance improves dramatically from 1.5V to 2.5V, but does not improve much from 2.5V to 5V. This example supports a preferable vanadium range of between about 1.5 wt % V and about 2.5 wt % V for corrosion resistance purpose, because smaller amounts of vanadium may not maximize the incremental benefit of additional V, and larger amounts of V may not perform much better than 2.5V.

Figure 1O:
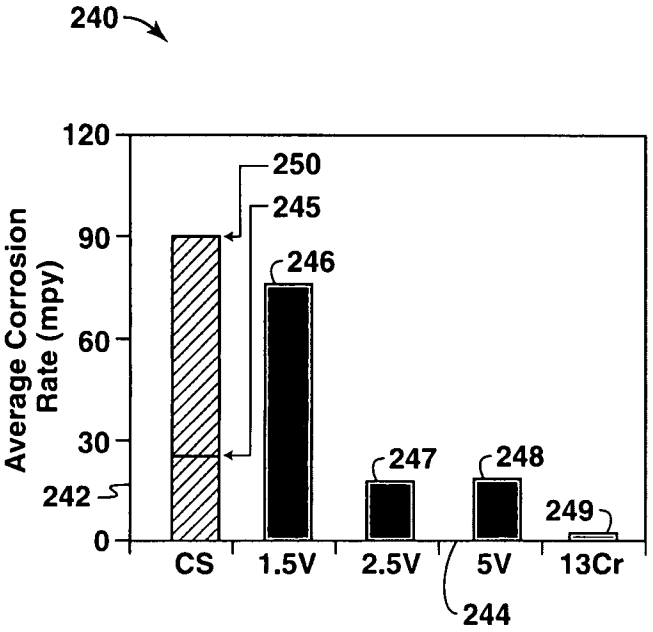

FIGS. 1O-1P compare the average corrosion rates of 1.5V, 2.5V and 5V CRCS steels with CS and 13Cr in a "scaling" testing environment. The corrosion rates are shown for measurements conducted in simulated aqueous production fluids that have compositions containing NaCl in an amount of about 10 wt %, sodium bicarbonate ($NaHCO_3$) in an amount of about 1.7 gram per liter (g/L), about 15 psi $CO_2$, pH of about 6.4, and temperature of about 180° F., which provide a scaling testing environment that promotes the formation of protective siderite scale on the steels being tested. FIG. 1O shows a chart 240 illustrating the average corrosion rates 242 in mpy for responses 245, 246, 247, 248, and 249 measured for different steel compositions 244. In this chart 240, the average corrosion rates 242 are obtained by averaging the instantaneous corrosion rates over about 160 hours from the start of the corrosion test. The responses 245, 246, 247, 248, and 249 are for the CS, 1.5V, 2.5V, 5V and 13Cr steel compositions, respectively. Also shown in this chart is the response 250 for CS, which is the peak instantaneous corrosion rate reached at about 25 hours, before the corrosion rate started to decline due to the formation of protective surface siderite scale. It is noted that the overall corrosion rate is lower for the scaling environment. Similar to the previously described corrosion rates in "scaling" testing environment in relation to FIGS. 1E and 1F, here it is noted that the V containing steels displayed corrosion rates lower than that of CS before its siderite scale is formed, and displayed corrosion rates comparable to that of CS after its siderite scale is formed, The chart 240 shows lower average corrosion rates 242 as the vanadium content increases. FIG. 1P shows chart 260 displaying the average corrosion rates of CS, 1.5V, 2.5V, and 5V as points and showing a free hand drawn trend line 256 for the four points. The chart also shows the response 267 of the peak instantaneous corrosion rate of CS at about 25 hours. It is noted that the improvement in corrosion resistance appears to be greatest from 1.5V to 2.5V, like in the non-scaling environment (see line 236 in chart 230). This example also appears to support a beneficial vanadium range from about 1.5 wt % to about 2.5 wt %.

The table of FIG. 2 summarizes the results obtained from visual examination of 5V CRCS and 5Cr steel coupons after about 120 hours exposure to the simulated water injection fluids that have compositions of simulated seawater prepared per ASTM-D1141 standard, containing dissolved oxygen ($O_2$) in an estimated amount of about 100 ppb, pH of about 8, and at a temperature of about 180° F. As shown in this table, little or no pitting was visible on the surface of the 5V CRCS coupon, whereas several pits resulting from localized corrosion were clearly visible on the surface of the 5Cr steel coupon. As such, these results show that in oxygenated water injection environments, the Cr containing steel and CRA compositions can suffer localized corrosion (i.e. pitting), whereas the V containing CRCS composition does not.

FIGS. 3A-3D show exemplary cross-section SEM micrographs and EDS elemental mappings of the corrosion surfaces on CRCS coupons produced in corrosion tests. These views show the relatively thick layers (20 μm to 50 μm thick) on the steel coupon corrosion surfaces that provide the beneficial corrosion protection described above in relation to FIGS. 1A-1L. These layers, as described below, are observed to be enriched in the V or Ti CRCS alloying elements.

Figure 3A:
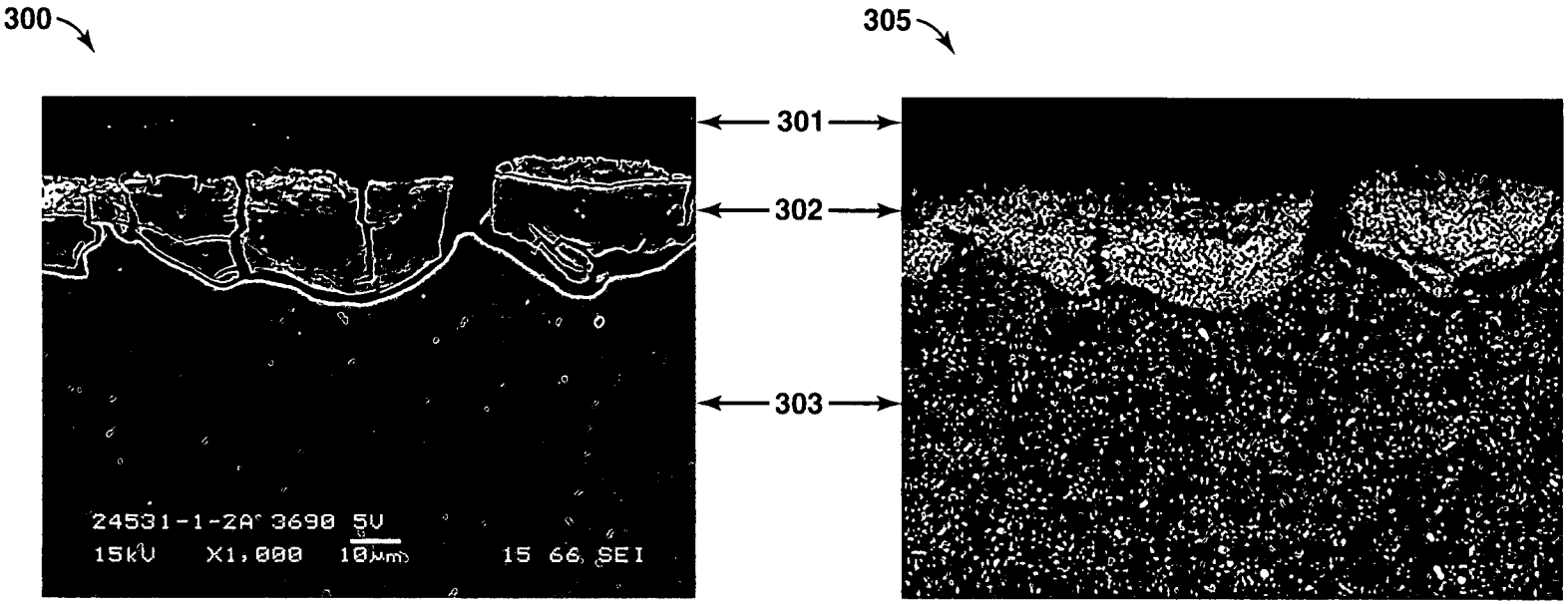
FIGS. 3A-3D are an exemplary cross-section Scanning Electron Microscope (SEM) and Energy Dispersive Spectra (EDS) views of the corrosion surface microstructures for the CRCSs after corrosion tests in accordance with aspects of the present invention.

FIG. 3A shows the cross-section SEM micrograph and an EDS elemental mapping of the corrosion surface on a 5V CRCS coupon after exposure for about 40 hours to a simulated aqueous production fluid that has a composition that includes NaCl in an amount of about 10 wt %, about 15 psi $CO_2$, pH of about 5, and a temperature of about 180° F., which provides a non-scaling testing environment that does not promote the formation of siderite scale on the steel being tested. In FIG. 3A, 300 is the cross-section SEM micrograph, 305 is the EDS elemental mapping of V in the same region, 302 is a surface layer of about 20 μm thick that provides the beneficial corrosion protection, 303 is the substrate 5V CRCS, and 301 is the epoxy sample mount. The EDS elemental mapping 305 shows an enhancement of V CRCS element in the protective surface layer.

Figure 3B:
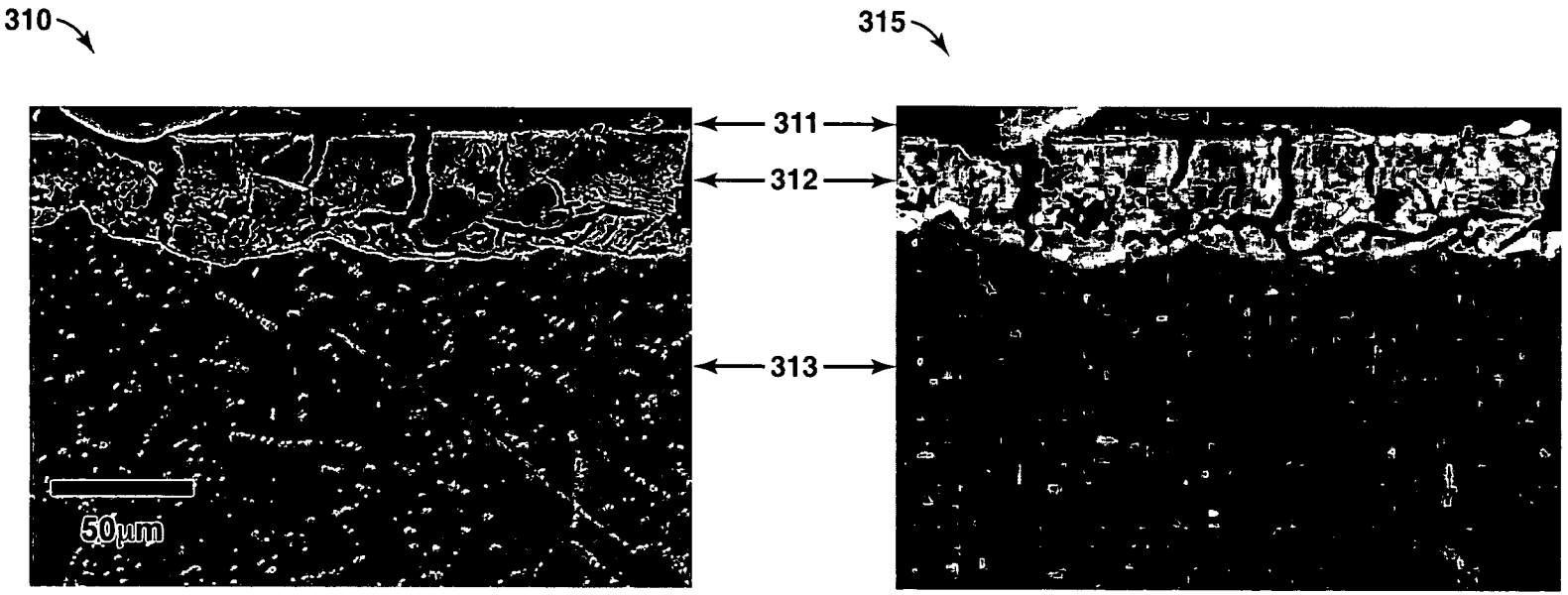

FIG. 3B shows the cross-section SEM micrograph and an EDS elemental mapping of the corrosion surface on a 5V CRCS coupon after exposure for about 140 hours to a simulated aqueous production fluid that has a composition that includes NaCl in an amount of about 10 wt %, about 100 psi $CO_2$, estimated pH of about 3.75, and a temperature of about 180° F., which provides a non-scaling testing environment that does not promote the formation of siderite scale on the steel being tested. In FIG. 3B, 310 is the cross-section SEM micrograph, 315 is the EDS elemental mapping of V in the same region, 312 is a surface layer of about 50 μm thick that provides the beneficial corrosion protection, 313 is the substrate 5V CRCS, and 311 is the epoxy sample mount. The EDS elemental mapping 315 shows an enhancement of V CRCS element in the protective surface layer.

Figure 3C:
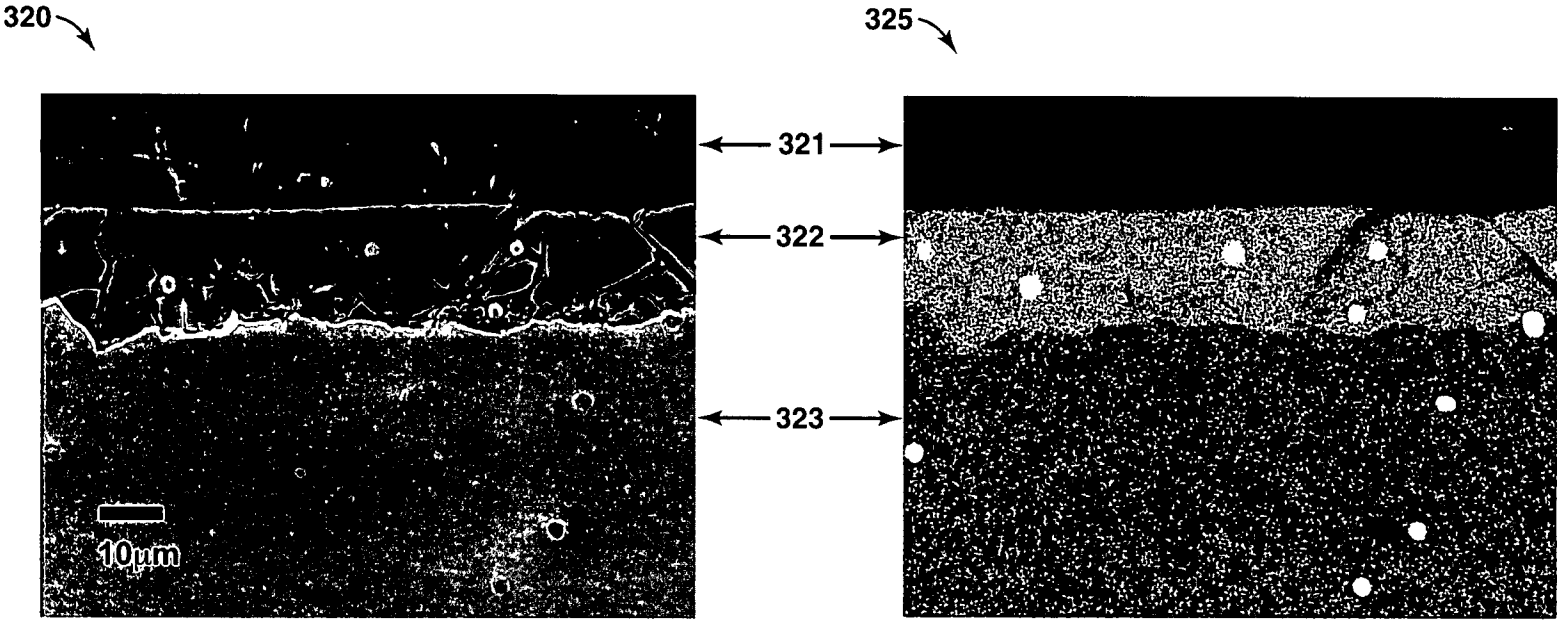

FIG. 3C shows the cross-section SEM micrograph and an EDS elemental mapping of the corrosion surface on a 5Ti CRCS coupon after exposure for about 40 hours to a simulated aqueous production fluid that has a composition that includes NaCl in an amount of about 10 wt %, about 15 psi $CO_2$, pH of about 5, and a temperature of about 180° F., which provides a non-scaling testing environment that does not promote the formation of siderite scale on the steel being tested. In FIG. 3C, 320 is the cross-section SEM micrograph, 325 is the EDS elemental mapping of Ti in the same region, 322 is a surface layer of about 20 μm thick that provides the beneficial corrosion protection, 323 is the substrate 5Ti CRCS, and 321 is the epoxy sample mount. The EDS elemental mapping 325 shows an enhancement of Ti CRCS element in the protective surface layer.

Figure 3D:
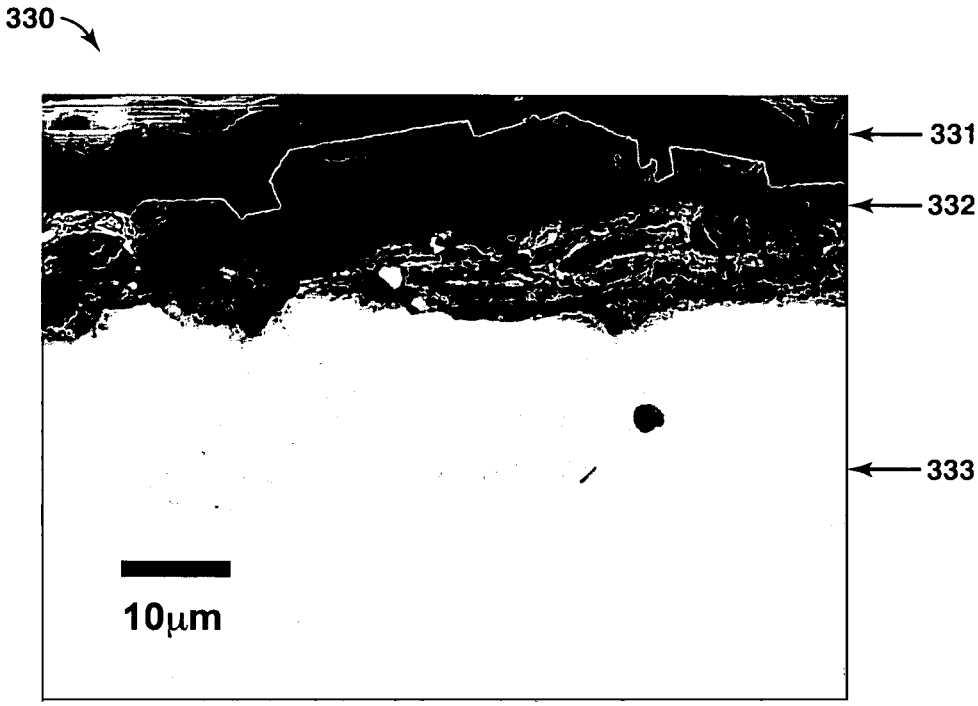

FIG. 3D shows the cross-section SEM micrograph of the corrosion surface on a 5Ti CRCS coupon after exposure for about 70 hours to a simulated aqueous production fluid that has a composition that includes NaCl in an amount of about 10 wt %, about 15 psi $CO_2$, pH of about 6.4, and a temperature of about 180° F., which provides a scaling testing environment that promotes the formation of siderite scale on the steel being tested. Here, instead of EDS elemental mapping, spot EDS analysis was carried out to determine the chemistry of different phases observed in this micrograph. In FIG. 3D, 330 is the cross-section SEM micrograph, 333 is a surface layer of about 5 μm thick that provides the beneficial corrosion protection, 332 is a top layer of siderite that is has thickness between about 5 μm to about 15 μm, 333 is the substrate 5Ti CRCS, and 331 is the epoxy sample mount. The EDS spot analysis on the surface layer 333 shows its at % ratio of Ti/Fe is about 1/1, which is a significant enhancement over the at % ratio of Ti/Fe of about 1/19 for the substrate 5Ti CRCS.

FIGS. 4A-4B are exemplary phase diagrams of the CRCS compositions calculated using a Thermo-Calc computer model in accordance with aspects of the present invention. In general, these phase diagrams show regions of various equilibrium steel phases in the plots of temperature versus the amounts of selected alloying elements. The equilibrium steel phases of concern here may include, but are not limited to, ferrite phase (α), austenite phase (γ), carbide phase (MC), Laves phase (intermetallics, e.g. $TiFe_2$), and the molten liquid phase (Liq). It is noted that there are additional meta-stable phases that are of concern here, which may include, but are not limited to, martensite phase (α') and tempered martensite phase (T−α'). These additional phases, being meta-stable, are generally not shown in the phase diagrams.

As discussed previously, one of the benefits from the present techniques is that low alloy CRCS chemistry provides a combination of enhanced surface properties with the specific bulk properties for a commercial structural material. Indeed, those skilled in the art may use the metallurgical phase diagrams to generate information on the relationships between the CRCS compositions, the suitable processings and the resulting microstructures. Accordingly, this information can be used to design suitable heat treatment procedures for specific CRCS compositions to produce beneficial microstructures that provide strength and toughness properties. These beneficial microstructures may include, but are not limited to, ones that comprise of predominantly ferrite phase, or predominantly martensite phase, or predominantly tempered martensite phase, or predominantly dual phase, where the dual phase may be either ferrite and martensite phases, or ferrite and tempered martensite phases. Additionally, the above mentioned beneficial microstructures may be further strengthened with second phase precipitates.

FIG. 4A shows a Thermo-Calc computer model calculated phase diagram for a V containing CRCS compositions, i.e. Fe—V system that contains 0.5Mn-0.1Si-0.15C in wt %. The phase diagram 400 in this FIG. is a plot in the form of temperature 401 in ° C., versus the V content 402 in wt %, and versus V content 403 in mole %. As an example of using the phase diagram 400 in FIG. 4A to design the suitable heat treatment procedures, the CRCS compositions containing V in the range of about 1 wt % to about 2.5 wt % may be heated to and annealed at appropriate high temperatures that are in the γ phase region and above MC containing region, and these temperatures may be determined from diagram 400. This annealing treatment dissolves all MC precipitates to homogenize the CRCS chemistry and induces phase transformation that converts the steel microstructures into ones that are essentially γ phase. The CRCS compositions may then be appropriately quenched to ambient temperature to transform most of the γ phase into the strong and hard α' phase. After quenching, the steels may be subjected to tempering by reheating to appropriate temperatures for sufficiently long time to improve the toughness properties of the α' phase. The appropriate tempering temperatures are in the range of about 400° C. up to or equal to the γ formation temperature, known as Ac1. and these temperatures may be determined from the phase diagram 400. After these heat treatments, the final microstructures of these CRCS compositions that contain V in the range of about 1 wt % to about 2.5 wt % are ones that comprise either predominantly α' or predominantly T−α' phases that are strong and tough.

As another example of using the phase diagram 400 in FIG. 4A to design the heat treatment procedures, the CRCS compositions containing V in the range of about 2.5 wt % to about 6 wt % may be heated to and annealed at appropriate high temperatures in the γ+α phase region and above MC containing region, and these temperatures may be determined from diagram 400. This annealing treatment dissolves all MC precipitates to homogenize the CRCS chemistry and converts the steel microstructures into ones that are essentially a mixture of γ and α phases. The ratio of the amounts of γ phase to that of a phase may be estimated using the "level rule" well known to those skilled in the arts. See Introduction to Physical Metallurgy, 2nd Ed., S. H. Avner (McGraw-Hill, London, 1974) p. 160. The CRCS compositions may then be appropriately quenched to ambient temperature, which transforms the γ phase into the strong and hard α' phase, but left the ferrite phase unaffected. After quenching, the steels may be subjected to tempering by reheating to appropriate temperatures for sufficiently long time to improve the toughness properties of the α' phase. The appropriate tempering temperatures are in the range from about 400° C. up to Ac1 temperature, and may be determined from the phase diagram 400. After these heat treatments, the final microstructures of these CRCSs that contain V in the range of about 2.5 wt % to about 6 wt % are ones that comprise of either predominantly dual α and α' phases, or predominantly dual α and T−α' phases.

As a third example of using the phase diagram 400 in FIG. 4A, it is noted that the CRCS compositions that have more than 6 wt % V may not be made to contain γ phase through heating, and hence their microstructures are ones that comprise of essentially a phase.

FIG. 4B shows a Thermo-Calc computer model calculated phase diagram for a Ti containing CRCS composition, i.e. Fe—Ti system that contains 0.5Mn-0.1Si-0.15C in wt %. The phase diagram 410 in this FIG. is a plot in the form of temperature 411 in ° C., versus the Ti content 412 in wt %, and versus Ti content 413 in mole %. As an example of using the phase diagram 410 in FIG. 4B to design the suitable heat treatment procedures, the CRCS compositions containing Ti in the range of about 1 wt % to about 1.8 wt % may be heated to and annealed at appropriate high temperatures that are in either the γ or the γ+MC phase regions, and these temperatures may be determined from diagram 400. This annealing treatment induces phase transformation that converts the steel microstructures into ones that are essentially γ phase that may also contain a small amount of MC phase. The CRCS compositions may then be appropriately quenched to ambient temperature to transform most of the γ phase into the strong and hard α' phase. After quenching, the steels may be subjected to tempering by reheating to appropriate temperatures for a sufficiently long time to improve the toughness properties of the α' phase. The appropriate tempering temperatures are from about 400° C. up to Ac1 temperature, and may be determined from the phase diagram 410. After these heat treatments, the final microstructures of these CRCSs that contain Ti in the range of about 1 wt % to about 1.8 wt % are ones that comprise of either predominantly α', or predominantly T−α' phases that are strong and tough.

As another example of using the phase diagram 410 in FIG. 4B to design the heat treatment procedures, the CRCS compositions containing Ti in the range of about 1.8 wt % to about 3 wt % may be heated to and annealed at appropriate high temperatures in the γ+α+MC phase region, and these temperatures may be determined from diagram 410. This annealing treatment converts the steel microstructures into ones that are essentially a mixture of γ and α phases with a small amount of MC phase. The ratio of the amount of γ phase to that of a phase may be estimated using the "level rule." The CRCS compositions may then be appropriately quenched to ambient temperature, which transforms the γ phase into the strong and hard α' phase, but left the α phase unaffected. After quenching, the steels may be subjected to tempering by reheating to appropriate temperatures for sufficiently long time to improve the toughness properties of the α' phase. The appropriate tempering temperatures are in the range of about 400° C. up to or equal to the Ac1 temperature, and may be determined from the phase diagram 410. After these heat treatments, the final microstructures of these CRCSs that contain Ti in the range of about 1.8 wt % to about 3 wt % are ones that comprise predominantly dual phase and a small amount of MC phase, in which the dual phase is either dual α and α' phases, or dual α and T−α' phases.

As additional examples of using the phase diagram 410 in FIG. 4B, it is noted that the CRCS compositions that have more than 3 wt % Ti may not be made to contain γ phase through heating, and hence their microstructures are ones that comprise of essentially a phase. It is further noted that for CRCS compositions that have more than 2 wt % Ti, the CRCSs may be subjected to additional reheating and annealing for a suitable period of time to form precipitates of the Laves ($TiFe_2$) phase that may provide additional strength.

End Uses of CRCS Compositions

As mentioned above, the steel is particularly useful for making oil and gas tubular members. The CRCS composition discussed above is amenable for conventional manufacturing process for end components, such as OCTG using conventional manufacturing processes (e.g., Mannesmann process). That is, other alloying additions included in this CRCS composition are utilized in conventional steel metallurgy, even though they are added for purposes other than corrosion resistance (e.g., mechanical properties). As such, the CRCS composition may be produced in steel mills with conventional manufacturing processes. These include, but are not limited to, melting, casting, rolling, forming, heating and quenching. Similarly, equipment and/or structures made from the CRCS composition also are fabricated using existing facilities with conventional production processes. As such, the fabrication of equipment from the CRCS composition is known in the art.

For example, in FIG. 5, an exemplary production system 500 in accordance with certain aspects of the present techniques is illustrated. In the exemplary production system 500, a production facility 502 is coupled to a tree 504 located on the Earth's surface 506. Through this tree 504, the production facility 502 accesses one or more subsurface formations, such as subsurface formation 508, which may include multiple production intervals or zones, having hydrocarbons, such as oil and gas. Beneficially, one or more devices 538 such as sand control devices, shunt tubes, and flow control valves, may be utilized to enhance the production of hydrocarbons from the production intervals of the subsurface formation 508. However, it should be noted that the production system 500 is illustrated for exemplary purposes and the present techniques may be useful in the production or injection of fluids from any subsea, platform or land location.

The production facility 502 may be configured to monitor and produce hydrocarbons from the production intervals of the subsurface formation 508. The production facility 502 may be a facility capable of managing the production of fluids, such as hydrocarbons, from wells and processing the processing and transportation of fluids to other locations. These fluids may be stored in the production facility 502, provided to storage tanks (not shown), and/or provided to a pipe line 512. The pipeline 512 may include various sections of line pipe coupled together. To access the production intervals, the production facility 502 is coupled to the tree 504 via a piping 510. The piping 510 may include production tubing for providing hydrocarbons from the tree 504 to the production facility To access the production intervals, the wellbore 514 penetrates the Earth's surface 506 to a depth that interfaces with the production intervals within the wellbore 514. As may be appreciated, the production intervals may include various layers or intervals of rock that may or may not include hydrocarbons and may be referred to as zones. The subsea tree 504, which is positioned over the wellbore 514 at the surface 506, provides an interface between devices within the wellbore 514 and the production facility 502. Accordingly, the tree 504 may be coupled to a production tubing string 528 to provide fluid flow paths and a control cable (not shown) to provide communication paths, which may interface with the piping 510 at the tree 504.

Within the wellbore 514, the production system 500 may also include different equipment to provide access to the production intervals. For instance, a surface casing string 524 may be installed from the surface 506 to a location at a specific depth beneath the surface 506. Within the surface casing string 524, an intermediate or production casing string 526, which may extend down to a depth near or through some of the production intervals, may be utilized to provide support for walls of the wellbore 514 and include openings to provide fluid communication with some of the production intervals. The surface and production casing strings 524 and 526 may be cemented into a fixed position within the wellbore 514 to further stabilize the wellbore 514. Within the surface and production casing strings 524 and 526, a production tubing string 528 may be utilized to provide a flow path through the wellbore 514 for hydrocarbons and other fluids.

Along this flow path, devices 538 may be utilized to manage the flow of particles into the production tubing string 528 with gravel packs (not shown). These devices 538 may include slotted liners, stand-alone screens (SAS); pre-packed screens; wire-wrapped screens, membrane screens, expandable screens and/or wire-mesh screens. In addition, packers 534 and 536 may be utilized to isolate specific zones within the wellbore annulus from each other. The packers 534 and 536 may be configured to provide or prevent fluid communication paths between devices 538 in different intervals. As such, the packers 534 and 536 and devices 538 may be utilized to provide zonal isolation and a mechanism for providing a substantially complete gravel pack within each interval.

To provide the corrosion resistance, CRCS material may be utilized to provide a suitable single material for use in conversion and dual purpose wells, such as wellbore 514. For example, in a conversion well formation fluids may flow through the devices 538 into the production tubing string 528 and are provided to the production facility 502 during production operations. Also, injection fluids may be provided to the intervals through the production tubing string 528 and devices 538 during injection operations. Accordingly, well tubulars, such as the production tubing string 528 and devices 538, are exposed to production fluids during production operations, and exposed to injection water during injection operations. If 13 wt % Cr steel equipment is utilized for the production tubing string 528, then a workover may have to be performed to upgrade the production tubing string 528 to at least 22% Cr duplex CRA steel equipment for water injection operations. However, if CRCS materials are utilized for the production tubing string 528, the workover may be eliminated, which reduces the operating costs for the well.

Alternatively, in dual purpose wells, tubular members may be exposed to formation fluids and injection fluids simultaneously. For instance, injection fluid, such as water, may be provided to the interval via the annulus between the production casing string 526 and the production tubing string 528, while formation fluids, such as hydrocarbons, are produced from the intervals through the production tubing string 528. As such, the production tubing string 528 is simultaneously exposed to production fluids on its outer surface and injection water on its inner surface, respectively. Typically, only production tubing string 528 made of a duplex material, such as 22% Cr, is able to handle this environment. However, a production tubing string 528 formed of CRCS material may provide a reduction of material costs over production tubing string 528 formed of a duplex material (i.e. duplex material cost is about 8 times the CRCS material cost).

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A steel composition, comprising:
vanadium in an amount of 1 wt % to 9 wt %,
titanium in an amount of 1 wt % to 9 wt %,
carbon in an amount of 0.03 wt % to 0.45 wt %;
manganese in an amount up to 2 wt %;
chromium in an amount from 1 wt % to less than 4 wt %;
silicon in an amount up to 0.45 wt %; and
with the balance being iron and minor amounts of impurities, wherein the steel composition has a steel microstructure that comprises of one of the following: predominantly ferrite, martensite, tempered martensite, dual phase ferrite and martensite, and dual phase ferrite and tempered martensite.

2. The steel composition of claim 1 further comprises vanadium in an amount of 1 wt % to 6 wt %.

3. The steel composition of claim 1 further comprises vanadium in an amount of 1.5 wt % to 2.5 wt %.

4. The steel composition of claim 1 further comprises titanium in an amount of 1 wt % to 3 wt %.

5. The steel composition of claim 1 further comprises titanium in an amount of 1 wt % to 2.2 wt %.

6. The steel composition of claim 1 wherein the combination of V and Ti is in the range of 2 wt % to an amount determined by equation below:

$$Ti(wt\ \%)=3.0(wt\ \%)-0.5\times V(wt\ \%)$$

where Ti(wt %) and V(wt %) are the amount of Ti and V additions in wt %, respectively.

7. The steel composition of claim 1 wherein the combination of V and Ti is in the range of 2 wt % to an amount determined by equation below:

$$Ti(wt\ \%)=2.2(wt\ \%)-0.55\times V(wt\ \%)$$

where Ti(wt %) and V(wt %) are the amount of Ti and V additions in wt %, respectively.

8. The steel composition of claim 1 wherein the combination of V and Ti is in the range of 2 wt % to an amount determined by equation below:

$$Ti(wt\ \%)=1.8(wt\ \%)-0.72\times V(wt\ \%)$$

where Ti(wt %) and V(wt %) are the amount of Ti and V additions in wt %, respectively.

9. The steel composition of claim 1, wherein the carbon is in a range from 0.03 wt % to 0.25 wt %.

10. The steel composition of claim 1, wherein the manganese is in a range from 0.5 wt % to 1.5 wt %.

11. The steel composition of claim 1, wherein the silicon is in a range from 0.1 wt % to 0.45 wt %.

12. The steel composition of claim 1, further comprising less than 3 wt % nickel.

13. The steel composition of claim 1, further comprising less than 0.03 wt % phosphorous.

14. The steel composition of claim 1, further comprising less than 0.03 wt % sulfur.

15. The steel composition of claim 1 further comprising a combination of chromium and vanadium in an amount of greater than 2 wt % to about 9 wt %.

16. The steel composition of claim 15 further comprising the combination of chromium and vanadium in an amount of greater than 2 wt % to about 3.5 wt %.

17. The steel composition of claim 1 further comprising a combination of chromium and titanium in an amount of 2 wt % to about 9 wt %.

18. The steel composition of claim 1, wherein the steel composition has a minimum yield strength of about 60 ksi with enhanced corrosion resistance.

19. The steel composition of claim 1, wherein the steel microstructure further comprises precipitates.

20. The steel composition of claim 1, comprising chromium in an amount from 1 wt % to less than 3 wt %.

21. A steel composition, comprising:
vanadium in an amount of 1 wt % to 9 wt %;
chromium in an amount of 1 wt % to about 3.5 wt %,
carbon in an amount less than about 0.45 wt %;
manganese in an amount less than about 2 wt %;
silicon in an amount less than about 0.45 wt %, and
titanium in an amount that satisfies the following equation:

$$Ti(wt\ \%)=3.0(wt\ \%)-0.5\times V(wt\ \%)$$

wherein the chromium and vanadium are combined in an amount of 2 wt % to about 9 wt % and the steel composition has a steel microstructure comprising one of the following: predominantly ferrite, martensite, tempered martensite, dual phase ferrite and martensite, and dual phase ferrite and tempered martensite.

22. The steel composition of claim 21, further comprises vanadium in an amount of about 1.5 wt % to about 2.5 wt %.

23. The steel composition of claim 21, wherein the carbon is in a range from about 0.03 wt % to about 0.25 wt %.

24. The steel composition of claim 21, wherein the manganese is in a range from about 0.5 wt % to about 1.5 wt %.

25. The steel composition of claim 21, further comprises nickel in an amount less than about 3 wt %.

26. The steel composition of claim 21 wherein the chromium and vanadium are combined in an amount of 2 wt % to 3.5 wt %.

27. The steel composition of claim 21, wherein the steel composition has a minimum yield strength of about 60 ksi with enhanced corrosion resistance.

28. The steel composition of claim 21, wherein the steel microstructure further comprises precipitates.

29. A steel composition to provide corrosion resistance comprising:

titanium in an amount of about 1 wt % to about 9 wt %;

chromium in an amount of 1 wt % to about 3.5 wt %, carbon in an amount less than about 0.45 wt %;

manganese in an amount less than about 2 wt %;

silicon in an amount less than about 0.45 wt %, and vanadium in an amount that satisfies the following equation:

$$Ti(\text{wt }\%)=3.0(\text{wt }\%)-0.5\times V(\text{wt }\%)$$

wherein the chromium and titanium are combined in an amount of about 2 wt % to about 9 wt % and the steel composition has a steel microstructure comprising one of the following: predominantly ferrite, martensite, tempered martensite, dual phase ferrite and martensite, and dual phase ferrite and tempered martensite.

30. The steel composition of claim 29 wherein the chromium and titanium are combined in an amount of about 2 wt % to about 3.5 wt %.

31. The steel composition of claim 29, wherein steel composition has a minimum yield strength of about 60 ksi with enhanced corrosion resistance.

32. The steel composition of claim 29 further comprising titanium in an amount of about 1 wt % to about 2.2 wt %.

33. The steel composition of claim 29, wherein the carbon is in a range from about 0.03 wt % to about 0.25 wt %.

34. The steel composition of claim 29, wherein the manganese is in a range from about 0.5 wt % to about 1.5 wt %.

35. The steel composition of claim 29 further comprising nickel in an amount less than about 3 wt %.

36. A method associated with the production of hydrocarbons comprising:

obtaining equipment to be utilized within a wellbore environment, wherein the equipment is at least partially formed from the steel composition of claim 21, 29, or 1 installing the equipment in the wellbore; and producing hydrocarbons through the equipment.

37. The method of claim 36, wherein the equipment comprises one or more of pipeline segments, flow lines and casing strings.

38. A method for producing corrosion resistant carbon steel (CRCS) comprising:

providing a steel composition of claim 21, 29, or 1 annealing the steel composition at a suitable temperature and for a suitable time period to substantially homogenize the steel composition and dissolve the precipitates;

suitably quenching the steel composition to produce one of predominantly ferrite microstructure, predominantly martensite microstructure and predominantly dual phase microstructures of ferrite and martensite.

39. The method of claim 38 wherein the annealing temperatures are in the range from about 850° C. to 1450° C. and annealing times are up to about 24 hours.

40. The method of claim 39, wherein the annealing temperatures for steel composition containing both V and Ti, are selected from the following equation:

$$T_{V+Ti}^{Anneal}(^\circ\text{ C.}) = \frac{V(\text{wt }\%)\times T_V^{Anneal}(^\circ\text{ C.}) + Ti(\text{wt }\%)\times T_{Ti}^{Anneal}(^\circ\text{ C.})}{V(\text{wt }\%) + Ti(\text{wt }\%)}$$

where V(wt %) and Ti(wt %) are respectively the amounts of V and Ti in wt %, $T_V^{Anneal}$ (° C.), $T_{Ti}^{Anneal}$ (° C.) are respectively the corresponding annealing temperatures in ° C. for steel composition having only the V or the Ti.

41. The method of claim 38 wherein the steel composition is further subjected to tempering temperatures between about 400° C. and the austenite formation temperature for up to about 12 hours.

42. The method of claim 41, wherein the tempering temperatures for the steel composition having both V and Ti, are selected from the following equation:

$$T_{V+Ti}^{Temper}(^\circ\text{ C.}) = \frac{V(\text{wt }\%)\times T_V^{Temper}(^\circ\text{ C.}) + Ti(\text{wt }\%)\times T_{Ti}^{Temper}(^\circ\text{ C.})}{V(\text{wt }\%) + Ti(\text{wt }\%)}$$

where $T_V^{Temper}$ (° C.), $T_{Ti}^{Temper}$ (° C.) are respectively the corresponding tempering temperatures in ° C.

43. The method of claim 39, wherein the steel composition is further subjected to one or more grain refining thermal cycles involving reheating the steel composition following initial annealing treatment to a temperature less than the annealing temperature and for times short enough to minimize grain growth.

44. The steel composition of claim 21, 29, or 1 wherein the steel composition instantaneous corrosion rate, as measured using electrochemical methodology in a non-scaling environment, is from about 50 to about 98 mils-per-year as measured at 40 hours.

* * * * *